US006311654B1

(12) United States Patent
Ushida et al.

(10) Patent No.: US 6,311,654 B1
(45) Date of Patent: Nov. 6, 2001

(54) VALVE TIMING ADJUSTING DEVICE

(75) Inventors: Masayasu Ushida, Okazaki; Osamu Sato, Takahama; Yasushi Morii, Nagoya; Tomomasa Oonishi, Kariya, all of (JP)

(73) Assignee: Denso Corporation (JP)

( * ) Notice: Subject to any disclaimer, the term of this patent is extended or adjusted under 35 U.S.C. 154(b) by 0 days.

(21) Appl. No.: 09/358,872

(22) Filed: Jul. 22, 1999

(30) Foreign Application Priority Data

| | | |
|---|---|---|
| Jul. 29, 1998 | (JP) | 10-213705 |
| Nov. 11, 1998 | (JP) | 10-320446 |
| Dec. 18, 1998 | (JP) | 10-360496 |

(51) Int. Cl.[7] ..... F01L 1/344

(52) U.S. Cl. ..... 123/90.17; 123/90.34; 123/90.37; 123/90.65

(58) Field of Search ..... 123/90.15, 90.17, 123/90.31, 90.33, 90.34, 90.37, 90.65

(56) References Cited

U.S. PATENT DOCUMENTS

| | | | |
|---|---|---|---|
| 4,858,572 | | 8/1989 | Okazaki et al. . |
| 5,012,774 | | 5/1991 | Strauber et al. . |
| 5,078,647 | | 1/1992 | Hampton . |
| 5,184,581 | | 2/1993 | Aoyama et al. . |
| 5,263,442 | | 11/1993 | Hara . |
| 5,520,145 | | 5/1996 | Nagai et al. . |
| 5,566,651 | | 10/1996 | Strauss et al. . |
| 5,588,404 | | 12/1996 | Lichti et al. . |
| 5,592,909 | | 1/1997 | Tsuruta . |
| 5,592,910 | | 1/1997 | Suga et al. . |
| 5,704,316 | * | 1/1998 | Fujimoto et al. ..... 123/90.17 |
| 5,775,279 | * | 7/1998 | Ogawa et al. ..... 123/90.17 |
| 5,813,378 | * | 9/1998 | Sato ..... 123/90.17 |
| 5,816,204 | * | 10/1998 | Moriya et al. ..... 123/90.17 |
| 5,836,277 | * | 11/1998 | Kira et al. ..... 123/90.17 |
| 5,870,983 | * | 2/1999 | Sato et al. ..... 123/90.17 |

FOREIGN PATENT DOCUMENTS

| | | |
|---|---|---|
| 2080923 A | 2/1982 | (GB) . |
| 2120320 A | 11/1983 | (GB) . |
| 2222660 A | 3/1990 | (GB) . |
| 2228780 A | 9/1990 | (GB) . |
| 2302391 A | 1/1997 | (GB) . |
| 2308636 A | 7/1997 | (GB) . |
| A3-54307 | 3/1991 | (JP) . |
| 4-358710 | 12/1992 | (JP) . |
| A-9-264110 | 10/1997 | (JP) . |
| A-10-68306 | 3/1998 | (JP) . |

* cited by examiner

*Primary Examiner*—Weilun Lo
(74) *Attorney, Agent, or Firm*—Nixon & Vanderhye PC

(57) ABSTRACT

A seal plate partitions a sectorial space which houses a vane and a circumferential groove which houses a torsion spring, so that the sectorial space is formed to prevent the communication between an advance angle pressure chamber and a retard angle pressure chamber regardless of the space of the circumferential groove. As a result, by setting the inner diameter of the vane smaller than the outer diameter of the torsion spring, the outer diameter of the vane can be made relatively small without lowering the engine performance. Therefore, it is possible to reduce the actuator in size without lowering the engine performance, to reduce the weight of a valve timing adjusting device and to obtain a mounting space easily for mounting the valve timing adjusting device on the engine.

13 Claims, 12 Drawing Sheets

VALVE TIMING ADJUSTING DEVICE

BACKGROUND OF THE INVENTION

1. Field of the Invention

The present invention relates to a valve timing adjusting device for changing the opening/closing timing (hereinafter referred to as the "valve timing") to open/close an intake valve and/or an exhaust valve of an internal combustion engine (hereinafter referred to as the "engine") in accordance with a drive condition.

2. Related Art

There has been known in the art a vane type valve timing adjusting device in which a cam shaft is driven by driving force transmitting mechanism such as a chain sprocket rotating in synchronism with the crankshaft of an engine so that the valve timing of at least one of the intake valve and the exhaust valve is controlled with a phase difference resulting from the relative rotations between the driving force transmitting mechanism and the cam shaft.

In this vane type valve timing adjusting device, a vane rotating with the cam shaft is housed in a housing rotating with the driving force transmitting mechanism. By adjusting the relative rotation phase difference of the vane to the housing hydraulically, moreover, the cam shaft and the driving force transmitting mechanism are rotated relatively to each other to adjust the valve timing of at least one of the intake valve and the exhaust valve in accordance with the drive condition of the engine.

The phase control valve timing adjusting device for controlling the valve timing of the engine valve aims at improving the stability and fuel efficiency of the engine or reducing the exhaust emission. At a light load condition of the engine of this kind, the intake air amount is so small as to make it desirable to reduce the residual exhaust gas, as might otherwise deteriorate the combustion, in the cylinder of the engine.

For a time period (or an overlap period) for which the intake valve and the exhaust valve are simultaneously open, a negative pressure is established on the intake side by the throttle, whereas a positive pressure prevails in the exhaust side. This may invite the case in which the exhaust gas is blown back to the intake side to deteriorate the combustion or to invite a misfire. Therefore, it is demanded to close the exhaust valve early and to open the intake valve late.

By retarding the timing for closing the intake valve, on the other hand, the pumping loss can be reduced to improve the fuel efficiency. At the idling time and the starting time, therefore, the control has to be made in the fundamental phase where the exhaust valve is closed early and where the intake valve is opened late. Here, the condition of this fundamental phase on the intake side defines the most retarded angle, and the condition on the exhaust side defines the most advanced angle.

At an intermediate or heavier load of the engine, however, the EGR ratio is controlled to reduce the pumping loss by the internal EGR thereby to improve the fuel economy and reduce the exhaust emission. This makes it necessary to advance the valve opening timing on the intake side or to retard the valve opening timing on the exhaust side. In short, the intake valve is controlled in the advancing direction whereas the exhaust valve is controlled in the retarding direction.

At the heaviest load of the engine, moreover, a large amount of air has to be introduced into the cylinder of the engine. This makes it necessary to close the intake valve early in the low speed range thereby preventing the reverse flow into the manifold and to make use of the inertia of the air in the high speed range thereby closing the intake valve late.

On the exhaust side, on the other hand, the exhaust valve is controlled to the phase capable of making the maximum use of exhaust pulsations so that the advanced angle has to be controlled to the maximum if the exhaust pulsations cannot be used. In short, on the exhaust side, the exhaust valve has to be controlled from the light load of the engine in the retarding direction from the most advanced position and again in the advancing direction in accordance with the load.

At this time the intake/exhaust valve can desirably be controlled quickly to the demanded phase if the drive condition changes. When it is impossible to control the intake/exhaust valve, however, there may occur a problem such as the misfire or the combustion instability of the engine.

Usually, the hydraulic pump of the engine is driven by the crankshaft. As a result, however, the flow amount of the oil to be discharged varies according to the rotation speed of the engine, and it decreases at a low rotation speed of the engine. As a result, the oil pressure may be decreased by the leakage and the drop of the viscosity especially at a high oil temperature, and the actuator may not operate. At this time, the intake side is retarded by the driving torque of the cam shaft so that it can take the fundamental phase. When an actuator having the same hydraulic piston area as that of the intake side, however, the exhaust side may not be controlled to the fundamental position, and the residual gas in the cylinder of the engine may increase to cause the misfire or stop the engine.

To solve the above problem, a valve timing adjusting device disclosed in JP-A-9-264110 moves the intake side to the retarded position or moves the discharge side to the advanced position by the biasing force of a torsion spring.

However, the torsion spring is structurally required to construct a spring around the whole circumference of the cam shaft. This requirement makes it necessary to form a housing space for housing the torsion spring, around the whole circumference of the cam shaft in the axial direction.

The vane type phase variable actuator generates an operating torque by controlling the oil pressure between the front and back of the vane members. If the aforementioned housing space is formed around the whole circumference of the cam shaft in the axial direction, therefore, the hydraulic chambers at the front and back of the vane members may be connected to fail to generate a pressure necessary for the operation.

In order to prevent the connection between the hydraulic chambers at the front and the back of the vane members, it is necessary to set the internal diameter of the hydraulic chamber, that is, the internal diameter of the vane members larger than an external diameter of the torsion spring. In short, the area across the vane members has to be retained to retain the oil pressure for rocking the vane members.

If the internal diameter of the vane members is set larger than the external diameter of the torsion spring, however, the external diameter of the hydraulic chamber, that is, the external diameter of the vane members has to be made relatively large. Accordingly, the actuator becomes bigger. This enlarged structure raises problems that the valve timing adjusting device is so raised in its weight and manufacturing cost as to make it difficult to mount it on the engine.

If the area across the vane members is enlarged by increasing the number of vane members so as to make the external diameter of the hydraulic chamber relatively small, on the other hand, there arises a problem that the number of parts increases to raise the manufacturing cost. Another problem is that the increase in the number of vane members reduces the rocking angle of the vane members so that the rocking angle of the vane members necessary for improving the engine performance cannot be achieved to lower the engine performance.

Further, a valve timing adjusting device disclosed in JP-A-10-68306 moves the discharge side to the advanced position by the biasing force of a torsion spring. Accordingly, when a vane type phase variable actuator is used, the response in the advancing direction is improved. However, the response in the retarding direction is compromised comparing to the one without the torsion spring.

Furthermore, when the vane is held at a predetermined position, hydraulic fluid, having higher pressure than that of hydraulic fluid to be supplied to the retard angle hydraulic chamber, is supplied to the advance angle hydraulic chamber. Accordingly, the pressure difference between the advance angle hydraulic chamber and the retard angle hydraulic chamber increases, and an oil leakage may occur therebetween.

Further, the area of the vane has to be increased in order to perform the phase control with substantially low hydraulic pressure. Accordingly, the actuator is increased in size, and the valve timing adjusting device is increased in weight and manufacturing cost. Thus, it may be difficult to mount it on the engine.

SUMMARY OF THE INVENTION

The invention is made in light of the foregoing problems, and it is an object of the present invention to provide a valve timing adjusting device which reduces the actuator in size without deteriorating the engine performance and obtains the mounting space easily for mounting itself on the engine.

Another object of the present invention is to provide a valve timing adjusting device which reduces the number of parts and the manufacturing cost.

Further, another object of the present invention is to provide a valve timing adjusting device which has a uniform response of the phase conversion and improves the controllability.

Further, another object of the present invention is to provide a valve timing adjusting device which reduces the leakage of the hydraulic fluid between the advance angle hydraulic chamber and the retard angle hydraulic chamber.

According to a valve timing adjusting device of the present invention, a partition member separates a housing chamber for housing a vane from a housing space for housing a spring. Accordingly, the housing chamber is formed to prevent the communication between an advance angle pressure chamber and a retard angle pressure chamber regardless of the housing space. As a result, by setting an inner diameter of the vane smaller than an outer diameter of the spring, an outer diameter of the vane is reduced without lowering the engine performance. Therefore, the actuator is reduced in size without lowering the engine performance, and the weight of a valve timing adjusting device is reduced, and a mounting space for mounting the valve timing adjusting device on the engine is easily obtained.

According to another aspect of the present invention, it includes a spring which applies biasing force to a vane in a direction in which the driven shaft advances against the drive shaft. Accordingly, the phase transition response is uniformed, and the controllability is improved.

Furthermore, since the pressure of a working fluid to be supplied to an advance angle pressure chamber is reduced, the pressure difference between the advance angle pressure chamber and a retard angle pressure chamber is reduced. Accordingly, the working oil leakage between the advance angle pressure chamber and the retard angle pressure chambers is reduced.

Furthermore, the area of the vane is reduced, and the actuator is reduced in size without compromising the engine performance. Accordingly, the weight of the valve timing adjusting device is reduced, and the mounting space for mounting it on the engine is easily obtained.

DESCRIPTION OF THE DRAWINGS

Additional objects and advantages of the present invention will be more readily apparent from the following detailed description of preferred embodiments when taken together with the accompanying drawings, in which.

DESCRIPTION OF PREFERRED EMBODIMENTS

Preferred embodiments of the present invention will now be described with reference to the accompanying drawings.

First Embodiment

An engine valve timing adjusting device according to a first embodiment of the present invention is shown in FIGS. 1 to 10. This valve timing adjusting device 100 in the first embodiment is a hydraulic control type for controlling the valve timing of an exhaust valve.

Figure 1:
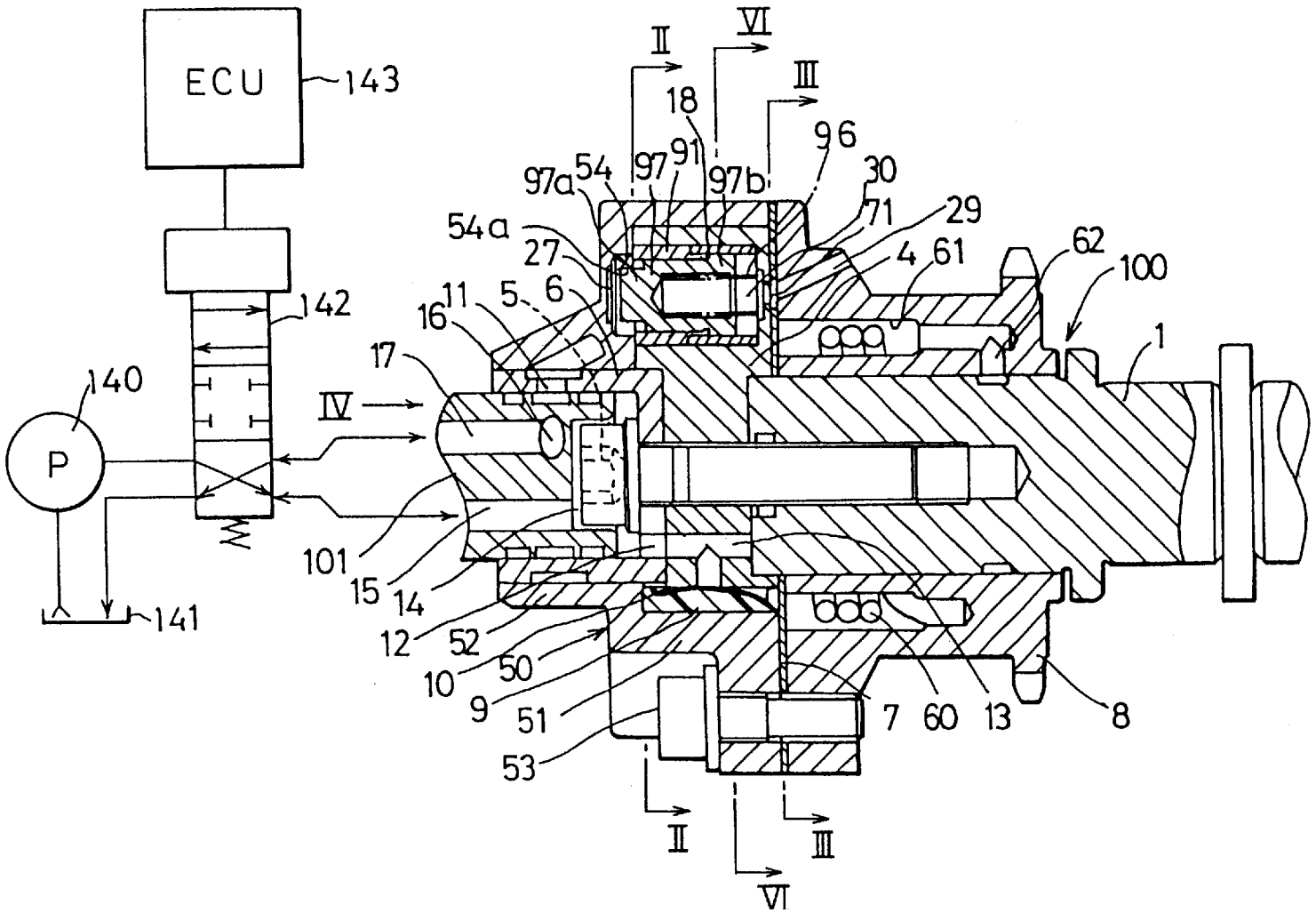
FIG. 1 is a longitudinal sectional view showing a valve timing adjusting device according to a first embodiment of the present invention.

A chain sprocket 8, as shown in FIG. 1, is coupled through the not-shown timing chain to a crankshaft acting as the drive shaft of the not-shown engine so that it is rotated in synchronism with the crankshaft by a driving force transmitted thereto. A front member 50 comprises a housing portion 51 and a bearing portion 52. The housing portion 51, the chain sprocket 8 and a later-described seal plate 7 are coupled by a bolt 53.

A cam shaft 1 acting as a driven shaft receives the driving force from the chain sprocket 8 to open/close the not-shown intake valve. The cam shaft 1 is supported by the not-shown cylinder head so that it can rotate with a predetermined phase difference relatively to the chain sprocket 8. This chain sprocket 8 and the cam shaft 1 rotate clockwise, as viewed from the left-hand side of FIG. 1. This rotating direction will be called the "advance direction" hereinafter.

The chain sprocket 8 and the front member 50 construct a housing member. A vane rotor 4 is covered at its two axial end surfaces with the seal plate 7 and the housing portion 51 of the front member 50. The chain sprocket 8, the seal plate 7 and the front member 50 construct a drive side rotor and are coupled on a common axis by the bolt 53.

A torsion spring 60 acting as first bias means is housed in a circumferential groove 61 formed as a housing space in the chain sprocket 8, and is fixed at its one end portion to the vane rotor 4 and at its other end to the chain sprocket 8. The torsion spring 60 biases the vane rotor 4 in the direction for the vane rotor 4 to advance with respect to the chain sprocket 8, that is, for the cam shaft 1 to advance with respect to the crankshaft.

An oil passage 62, as extended from the circumferential groove 61 to the side opposite to the front member, is formed to lubricate a sliding portion, that is, a bearing portion between the cam shaft 1 and the chain sprocket 8 with the working oil leaking into the circumferential groove 61.

Figure 2:
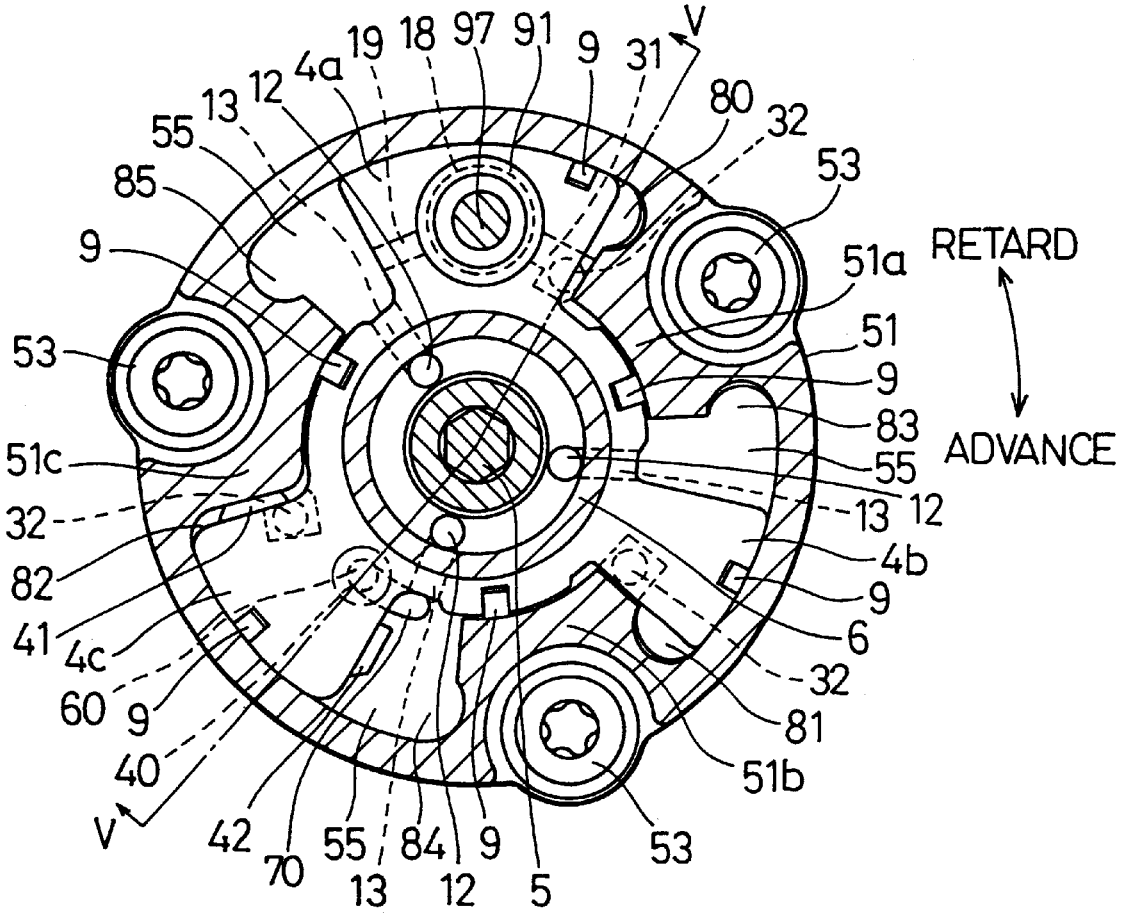
FIG. 2 is a sectional view taken along line II—II of FIG. 1.

As shown in FIG. 2, the housing member 51 of the front member 50 has shoes 51*a*, 51*b* and 51*c* formed in a trapezoidal shape at a substantially equal spacing in the circumferential direction. In the three circumferential clearances of the shoes 51*a*, 51*b* and 51*c*, there are individually formed sectorial spaces 55 as housing chambers for housing vanes 4*a*, 4*b* and 4*c* as vane members. Inner circumferential surface of the shoes 51*a*, 51*b* and 51*c* are formed to have an arcuate cross section.

The vane rotor 4 is provided substantially equidistantly in the circumferential direction with the vanes 4*a*, 4*b* and 4*c* which are rotatably housed in the sectorial spaces 55 formed in the circumferential clearances of the shoes 51*a*, 51*b* and 51*c*.

The vane 4*c* is provided on the advance side with an advance stopper 41 and on the retard side with a retard stopper 42. Arrows, as appearing in FIG. 2, indicate the retard direction and the advance direction of the vane rotor 4 with respect to the housing portion 51.

In FIG. 2, each vane is positioned at one circumferential end portion of each sectorial space 55 so that the vane rotor 4 is positioned at the most advanced position with respect to the housing portion 51. The most advanced position is regulated by retaining the advance stopper 41 on the retard side face of the shoe 51*c*. On the other hand, the most retarded position is regulated by retaining the retard stopper 42 on the advance side face of the shoe 51*c*.

The advance stopper 41 and the retard stopper 42 construct regulation means. As shown in FIG. 1, the vane rotor 4 is coupled integrally to the cam shaft 1 by a bolt 5, and a bush 6 is press-fitted in and supported by the vane rotor 4 to construct a driven side rotor.

Figure 5:
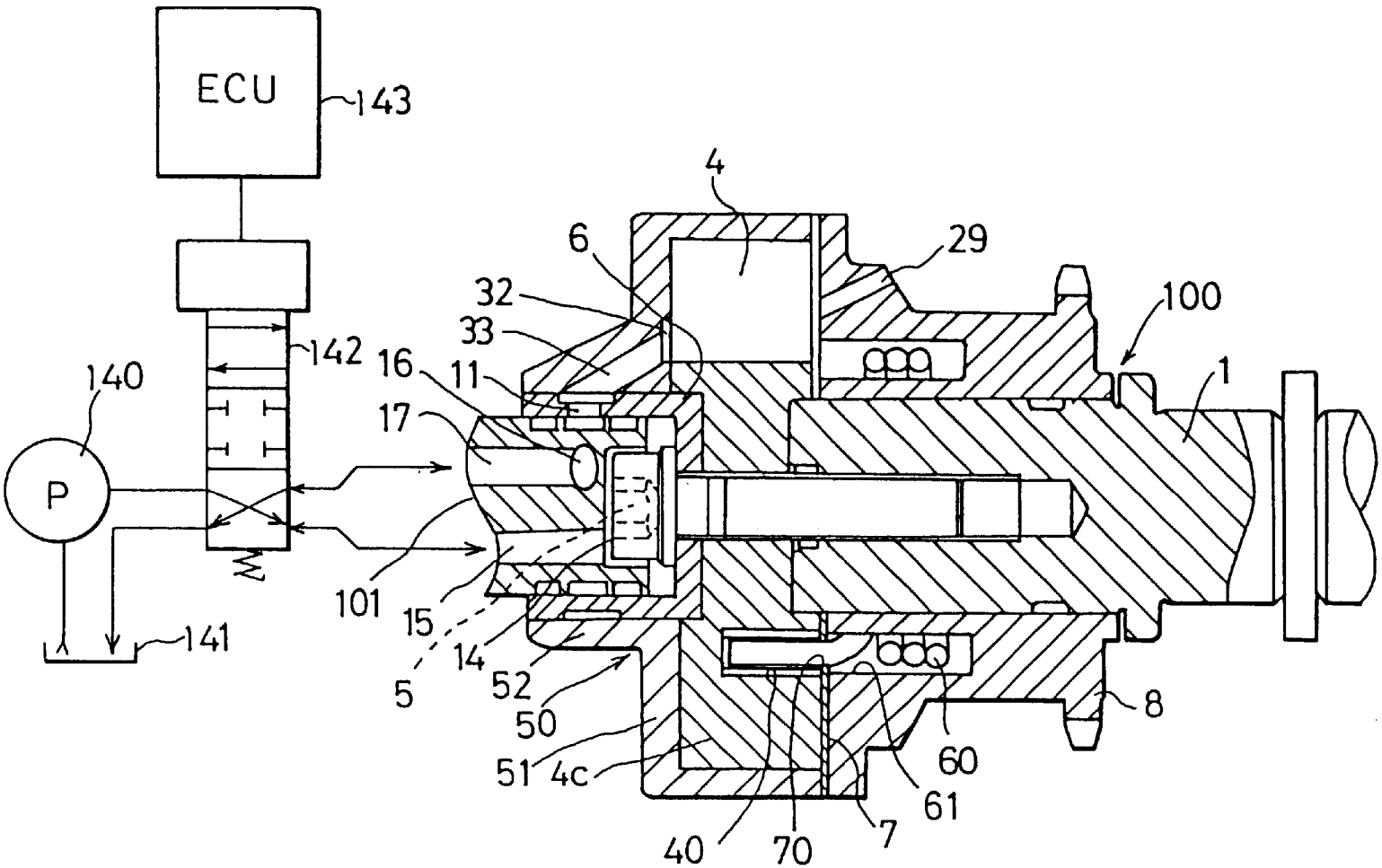
FIG. 5 is a sectional view taken along line V—V of FIG. 2.

As shown in FIG. 1, the vanes 4*a*, 4*b* and 4*c* are set to have an internal diameter smaller than the external diameter of the torsion spring 60. As shown in FIG. 5, on the other hand, the vane 4*c* is provided with a fixing hole 40 for fixing one end portion of the torsion spring 60. By fixing the other end portion of the torsion spring 60 to the chain sprocket 8, therefore, this torsion spring 60 can be assembled without providing any special member for receiving the biasing force of the torsion spring 60 having a larger external diameter than the internal diameter of the vanes 4*a*, 4*b* and 4*c*. Moreover, the fixing hole 40 is easily formed because the vane 4*c* having the advance stopper 41 and the retard stopper 42 is made thicker than the vane 4*b* so as to retain the strength.

The cam shaft 1 and the bush 6 are so individually fitted as to rotate relatively to the bearing portion 52 of the front member 50. As a result, the cam shaft 1 and the vane rotor 4 can rotate coaxially relatively to the chain sprocket 8 and the front member 50.

As shown in FIG. 2, the seal member 9 is fitted on the outer circumferential wall of the vane rotor 4. A small clearance is provided between the outer circumferential wall of the vane rotor 4 and the inner circumferential wall of the housing portion 51 of the front member 50. Seal members 9 prevents the leakage of the working oil through the clearance between the oil pressure chambers. As shown in FIG. 1, the seal members 9 are individually biased onto the inner circumferential wall of the housing portion 51 by the spring forces of leaf springs 10.

In the inner wall of the vane 4*a*, as shown in FIG. 2, there is press-fitted a guide ring 91, into which there is inserted a stopper piston 97 as an abutting portion. As shown in FIG. 1, the stopper piston 97 is formed into a bottomed cylindrical shape of a substantially equal external diameter, which is composed of a bottomed cylindrical portion 97*a* and a flange portion 97*b* formed at the open end portion of the cylindrical portion 97*a*. The stopper piston 97 is so fitted in the guide ring 91 as to slide in the axial direction of the cam shaft 1. The stopper piston 97 is biased to the side opposite to the chain sprocket by a spring 96 acting as second bias means.

In the stopper hole formed in the housing portion 51 of the front member 50, there is press-fitted a fitting ring 54 having a tapered hole 54*a* acting as an abutted portion, so that the stopper piston 97 can be fitted in the tapered hole 54*a* when in the most advanced position shown in FIG. 2. When the stopper piston 97 is so fitted in the tapered hole 54*a* that the former comes into abutment against the latter in the rotational direction, the vane rotor 4 is restrained from rotating relatively to the housing portion 51. In short, the stopper piston 97 and the tapered hole 54*a* take the restrained positions at the most advanced position. The stopper piston 97, the tapered hole 54*a* and the spring 96 construct restraint means.

The oil pressure chamber 18, as located on the left-hand side of the flange portion 97*b*, has communication with a later-described advance angle oil pressure chamber 85 via an oil passage 19 shown in FIG. 2. On the other hand, an oil pressure chamber 27, as formed on the tip of the cylindrical portion 97*a*, has communication with a later-described retard angle oil pressure chamber 80 via an oil passage 31 shown in FIG. 2.

The area of a first pressure receiving surface of the flange portion 97*b* for receiving the oil pressure of an oil pressure chamber 18 is set smaller than that of a second pressure receiving surface of the cylindrical portion 97*a* for receiving the oil pressure of the oil pressure chamber 27. The pressures to be received by the first pressure receiving surface and the second pressure receiving surface from the working oils in the oil pressure chamber 18 and the oil pressure chamber 27 respectively act to extract the stopper piston 97 from the tapered hole 54*a*.

The pressure receiving area of the first pressure receiving surface is substantially equal to the annular area corresponding to the diametrical difference between the flange portion 97*b* and the cylindrical portion 97*a*, and the pressure receiving area of the second pressure receiving surface is substantially equal to the sectional area of the cylindrical portion 97*a*. When a working oil under a predetermined or higher pressure is fed to the advance angle oil pressure chamber 85 or the retard angle oil pressure chamber 80, the stopper piston 97 comes out of the tapered hole 54*a* against the biasing force of the spring 96.

The position of the stopper piston 97 and the position of the tapered hole 54*a* are so relatively set that the stopper piston 97 can be fitted in the tapered hole 54*a* by the biasing force of the spring 96 when the vane rotor 4 is at the most advanced position relatively to the housing portion 51 of the front member 50, that is, when the cam shaft 1 is at the most advanced position relatively to the crankshaft.

As shown in FIG. 2: the retard angle oil pressure chamber 80 is formed between the shoe 51*a* and vane 4*a*; a retard angle oil pressure chamber 81 is formed between the shoe 51b and the vane 4*b*; and a retard angle oil pressure chamber 82 is formed between the shoe 51*c* and the vane 4*c*. On the other hand: an advance angle oil pressure chamber 83 is formed between the shoe 51aand the vane 4*b*; an advance angle oil pressure chamber 84 is formed between the shoe 51*b* and the vane 4*c*; and the advance angle oil pressure chamber 85 is formed between the shoe 5*c* and the vane 4*a*.

As shown in FIG. 1, the seal plate 7 as a partition member separates the sectorial space 55 from the circumferential groove 61. In other words, the seal plate 7 separates a housing chamber for housing the vanes 4*a*, 4*b* and 4*c* from a housing chamber for housing the torsion spring 60. As a result, the sectorial space 55 is constructed such that the advance angle oil pressure chambers 83, 84 and 85 and the retard angle oil pressure chambers 80, 81 and 82 are not connected regardless of the space of the circumferential groove 61.

Figure 8:
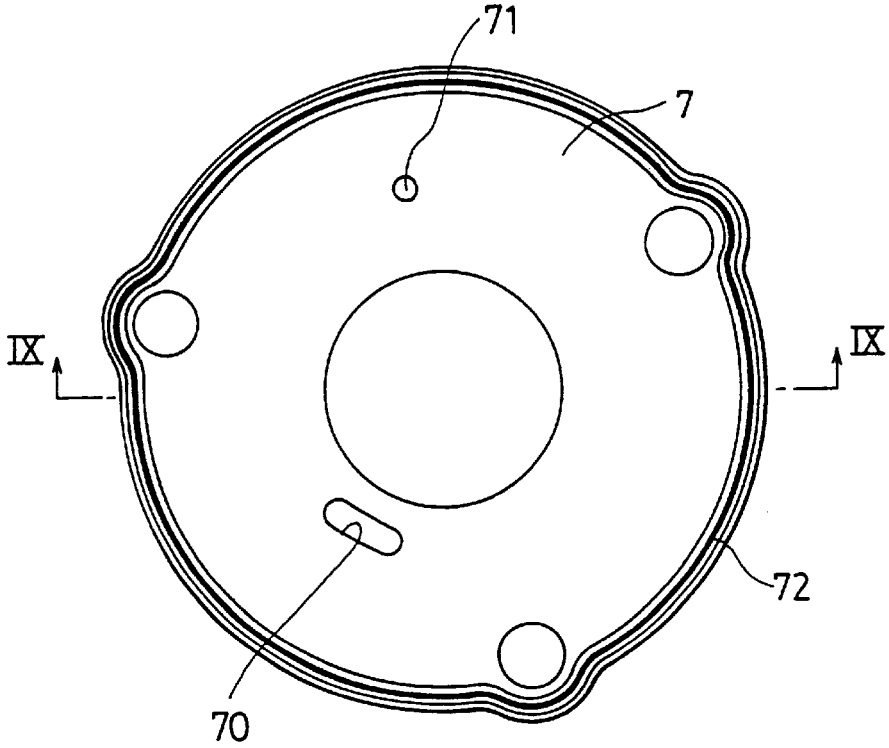
FIG. 8 is a top plan view showing a seal plate of the first embodiment of the present invention.
Figure 9:
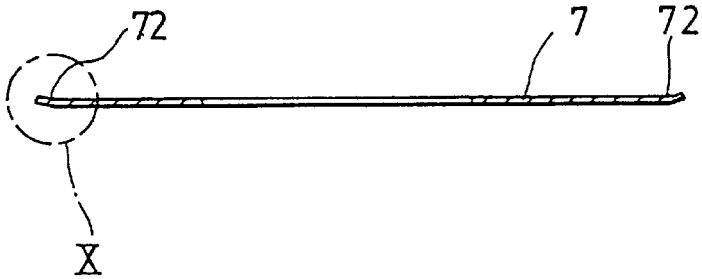
FIG. 9 is a sectional view taken along line IX—IX of FIG. 8.
Figure 10:
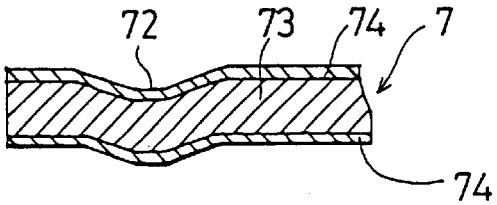
FIG. 10 is an enlarged view of a portion X of FIG. 9.

Over the whole circumference of the seal plate 7, as shown in FIGS. 8, 9 and 10, there is formed a corrugation 72. This seal plate 7 is constructed of a metal plate 73 and elastic members 74. These elastic members 74 are provided by adhering or coating them on the two faces of the metal plate 73 and are made of an elastic material such as acrylic rubber resisting to heat or the working oil. As a result, a seal member such as an O-ring need not be provided so that the number of parts can be reduced.

Moreover, a groove for the O-ring need not be formed in the seal plate 7 so that the number of manufacture steps can be reduced. This makes it possible to lower the manufacture cost and to prevent the working oil reliably by the simple construction from leaking from the sectorial space 55 or the circumferential groove 61 to the outside. Here, the corrugation 72 and the elastic members 74 construct seal means.

Figure 3:
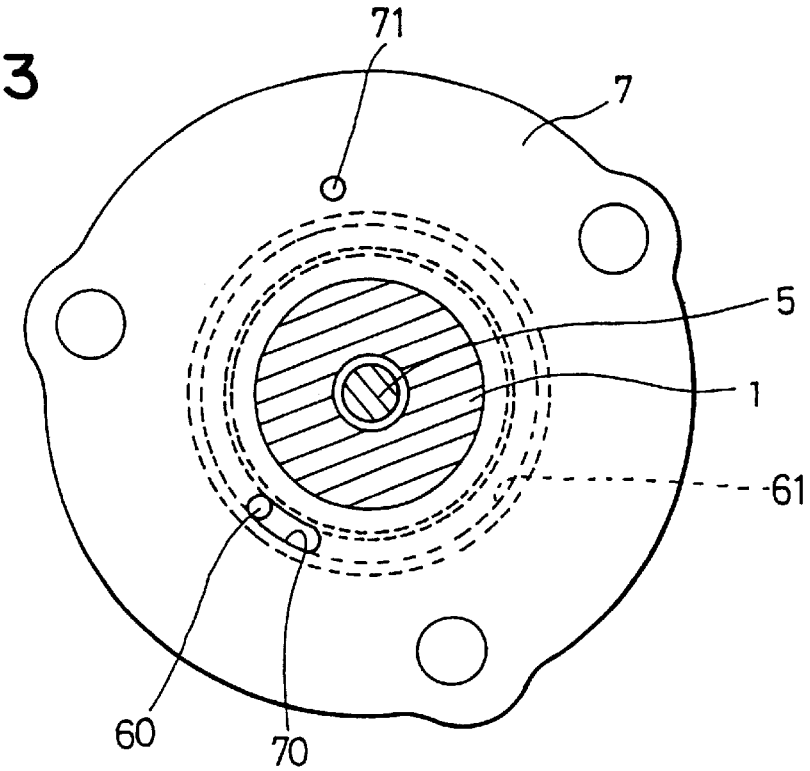
FIG. 3 is a sectional view taken along line III—III of FIG. 1.

As shown in FIG. 3, a circumferentially elongated through hole 70 is formed in the seal plate 7. This through hole 70 receives one end portion of the torsion spring 60. As shown in FIG. 2, the through hole 70 has communication with the advance angle oil pressure chamber 84 but not with the retard angle oil pressure chamber 82. As a result, the vanes 4*a*, 4*b* and 4*c* rotate in the retarding direction from the most advanced angular reference phase so that the vane 4*c* can shut the through hole 70 as the vanes 4*a*, 4*b* and 4*c* rotate.

Figure 6:
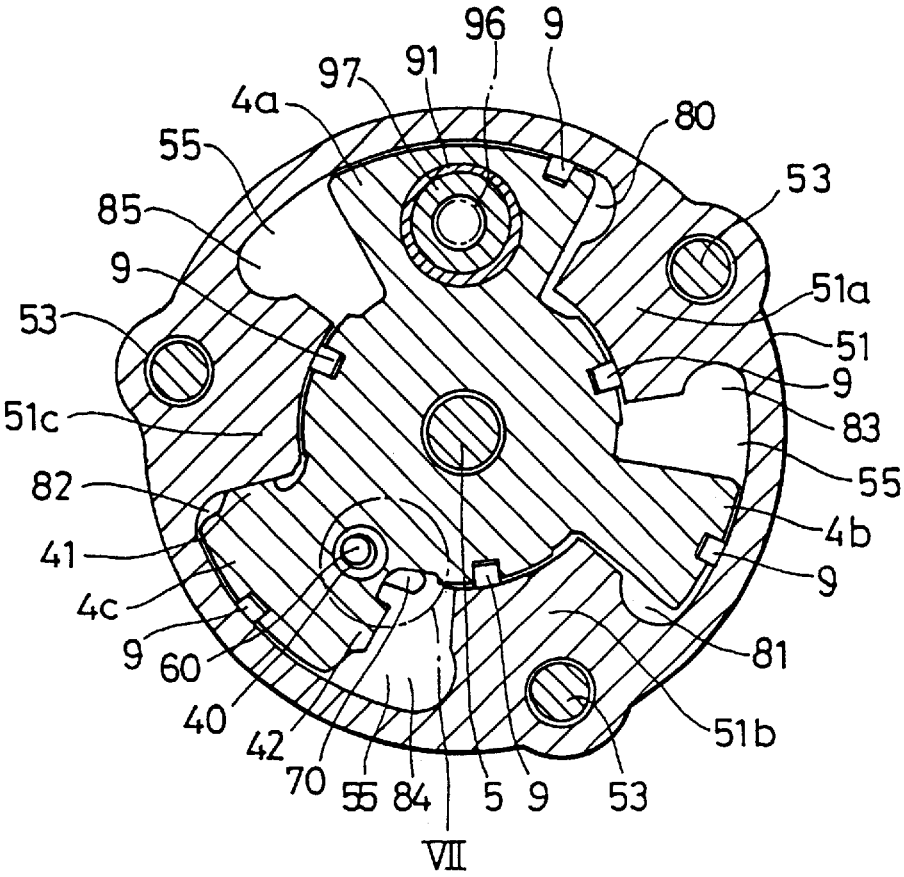
FIG. 6 is a sectional view taken along line VI—VI of FIG. 1.
Figure 7:
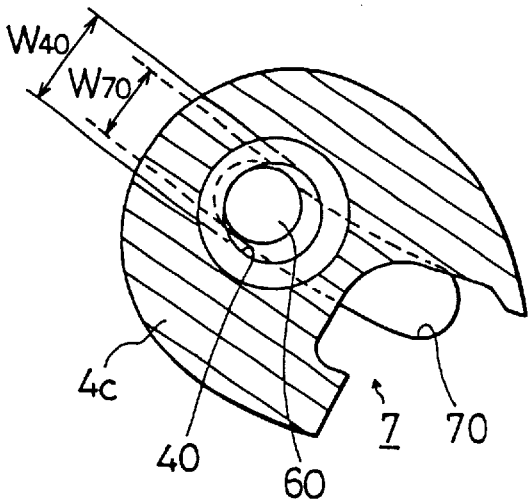
FIG. 7 is an enlarged view of a portion VII of FIG. 6.

If the fixing hole 40 has an internal diameter $W_{40}$ and if the through hole 70 has a diametrical width $W_{701}$, as shown in FIGS. 6 and 7, the following relation is established:

$$W_{40}>W_{70}$$

Specifically, the width of the fixing hole 40 in the radial direction of the vane rotor 4 is greater than the width of the through hole 70 in the radial direction of the seal plate 7. As a result, the biasing force of the torsion spring 60 in the radial direction of the vane rotor 4 is restricted by the inner wall of the through hole 70 so that it is prevented from being transmitted to the vane 4*c*.

Therefore, the vanes 4*a*, 4*b* and 4*c* can be prevented from becoming eccentric and from being eccentrically worn, as might otherwise be caused by the frictions between the vanes 4*a*, 4*b* and 4*c* and the inner wall of the housing portion 51 forming the sectorial space 55. Moreover, the vanes 4*a*, 4*b* and 4*c* are easily assembled with the housing portion 51 so that the number of manufacturing steps can be reduced. Here, the through hole 70 constructs guide means.

In the seal plate 7, as shown in FIG. 3, there is formed a communication passage 71 which communicates with a back pressure chamber 30 of the stopper piston 97 shown in FIG. 1. The communication passage 71 communicates with the atmosphere in the oil lubricating space of the not-shown engine via an oil passage 29 formed in the chain sprocket 8 at the most advanced position, so that the back pressure chamber 30 communicates with the atmosphere at the most advanced position. As a result, the movement of the stopper piston 97 is not prevented at the most advanced position.

In the vane rotor 4, as shown in FIG. 1, an oil passage 13 is formed at the portion abutting against the cam shaft 1, and an oil passage 12 is formed at the portion abutting against the bush 6. The oil passage 13 communicates with either an hydraulic pump 140 functioning as drive means or a drain 141 via the oil passage 14 formed between the cam shaft 1 and the bolt 5 via the oil passage 12, and an oil passage 15 formed in a housing 101, and through a change-over valve 142.

The hydraulic pump 140 also functions as a drive source for the engine lubricating oil. As shown in FIG. 2, moreover, the oil passage 13 communicates with the advance angle oil pressure chambers 83, 84 and 85. On the other hand, the oil passage 13 communicates with the oil pressure chamber 18 via the oil passage 19.

Figure 4:
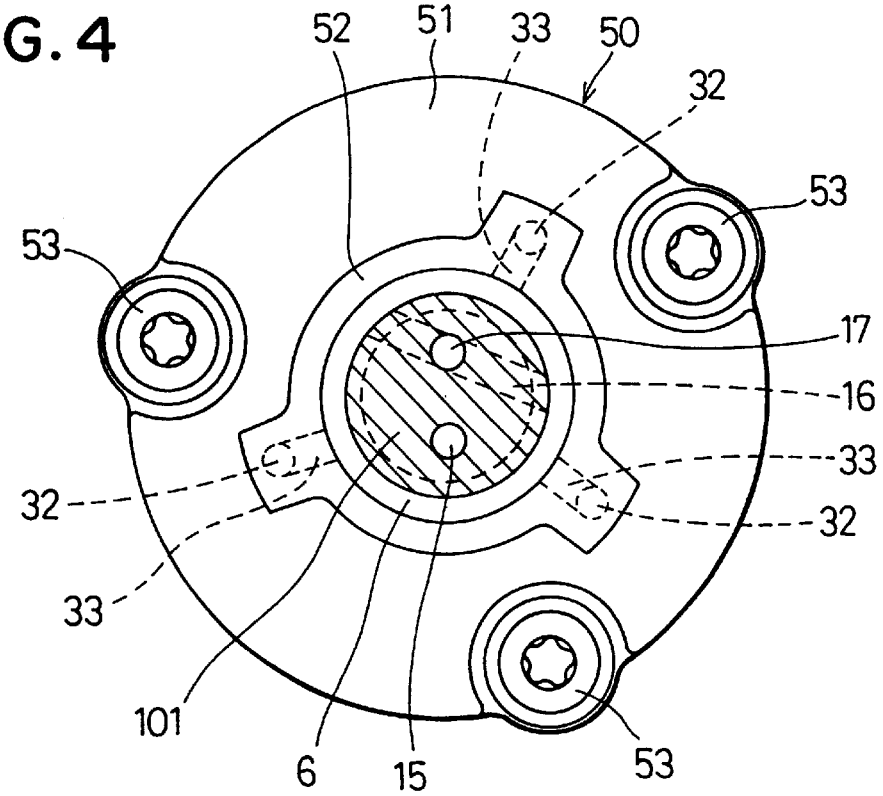
FIG. 4 is a side view taken in the direction of IV of FIG. 1.

In the housing portion 51 of the front member 50, as shown in FIGS. 4 and 5, an oil passage 32 is formed at the portion abutting against the vane rotor 4. The oil passage 32 communicates with the hydraulic pump 40 or the drain 41 via an oil passage 33 formed in the bearing portion 52 of the front member 50, and oil passages 16 and 17 formed in the housing 101 via a whole circumference groove 11 formed in the housing 101, and the change-over valve 142.

Moreover, the oil passage 32 communicates with the retard angle oil pressure chambers 80, 81 and 82, and also communicates with the oil pressure chamber 27 via the oil passage 31 shown in FIG. 2. In response to an instruction from an electronic control unit (ECU) 143, the change-over valve 142 changes the connection states between the oil passages 15, 17 and the hydraulic pump 40 and the drain 141.

Here will be described the operations of the valve timing adjusting device 100.

(1) When the engine stops normally, the change-over valve 142 is so controlled by the instruction of the ECU 143 that the retard angle oil pressure chambers 80, 81 and 82 are released to the drain side whereas the individual advance angle oil pressure chambers 83, 84 and 85 are held in the working oil pressure applied state. Then, the vane rotor 4 moves to the most advanced position with respect to the housing portion 51 of the front member 50, and the housing portion 51 and the vane rotor 4 are coupled by the restraint means so that the cam shaft 1 is held in the most advanced position with respect to the housing portion 51.

According to the first embodiment of the present invention, it is designed to have no overlap for valve opening period between the exhaust valve and the intake valve at the most advanced position shown in FIG. 2. Accordingly, it can reduce the internal EGR ratio and start the engine normally. Even after the engine is started, the housing portion 51 and the vane rotor 4 are held in the coupled state by the restraint means. As a result, the cam shaft 1 is at the most advanced position with respect to the housing portion 51 till the working oil pressure to be applied to the individual oil passages and the individual oil pressure chambers exceeds a predetermined level.

(2) When the engine turns into the normal driving condition and a working oil whose pressure is higher than the predetermined level is introduced into the respective oil passages and oil pressure chambers, the pressure is applied to the second pressure receiving surface by the negative peak torque of the fluctuating torque of the cam shaft 1 during the idling at a high oil temperature, thereby releasing the coupling between the housing portion 51 and the vane rotor 4 with the restraint means.

At this time, no shearing force is applied to catch the stopper piston 97 so that the housing portion 51 and the vane rotor 4 can be promptly released from their restraint. As a result, the vane rotor 4 is rotated relatively to the housing portion 51 against the biasing force of the torsion spring 60 by the working oil pressure applied to the retard angle oil pressure chambers 80, 81 and 82 and the advance angle oil pressure chambers 83, 84 and 85, so that the phase difference of the cam shaft 1 relatively to the housing portion 51 is adjusted.

In the first embodiment of the present invention, the seal plate 7 separates the sectorial space 55 for housing the vanes 4*a*, 4*b* and 4*c* from the circumferential groove 61 for housing the torsion spring 60. Accordingly, the sectorial space 55 prevents the communication between the advance angle oil pressure chambers 83, 84 and 85 and the retard angle oil pressure chambers 80, 81 and 82 regardless of the space of the circumferential groove 61.

As a result, the external diameter of the vanes 4*a*, 4*b* and 4*c* can be relatively reduced without lowering the engine performance by setting the internal diameter of the advance angle oil pressure chambers 83, 84 and 85 and the retard angle oil pressure chambers 80, 81 and 82, that is, the internal diameter of the vanes 4*a*, 4*b* and 4*c* smaller than the external diameter of the torsion spring 60.

Therefore, it is possible to reduce the actuator in size without lowering the engine performance, to reduce the weight of the valve timing adjusting device 100 and to retain the mounting space easily for mounting the valve timing adjusting device on the engine. Moreover, since the actuator is reduced in size with the simple structure, the manufacturing cost is also reduced.

Furthermore, according to the first embodiment, the vane 4*c* has the fixing hole 40 for fixing one end portion of the torsion spring 60. By fixing the other end portion of the torsion spring 60 on the chain sprocket 8, therefore, the torsion spring 60 can be assembled without providing any special member for receiving the biasing force of the torsion spring 60 having a larger external diameter than the internal diameter of the vanes 4*a*, 4*b* and 4*c*.

Moreover, the vane 4*c* having the advance side stopper 41 and the retard side stopper 42 is made thicker than the vane 4*b* in order to obtain the strength, so that the fixing hole 40 can be easily formed. As a result, the manufacturing cost can be further reduced with the simple structure.

In the first embodiment, moreover, the through hole 70 formed in the seal plate 7 communicates with the advance angle oil pressure chamber 84 but not with the retard angle oil pressure chamber 82. Since the vanes 4*a*, 4*b* and 4*c* rotate from the most advanced reference phase to the retarding direction, the vane 4*c* is enabled to shut the through hole 70 by the rotations of the vanes 4*a*, 4*b* and 4*c*.

As a result, the seal length of the vane 4*c* is not reduced, as might otherwise be caused by the rotations of the vanes 4*a*, 4*b* and 4*c* in the retarding direction, so that the angle of the vanes 4*a*, 4*b* and 4*c* necessary for shutting the through hole 70 can be set at a relatively small value. By setting the rocking angle of the vanes 4*a*, 4*b* and 4*c* to a relatively large value, therefore, the exhaust emission of the engine can be reduced.

At the equal rocking angle of the vanes 4*a*, 4*b* and 4*c*, moreover, the leakage of the fluid from the through hole 70 can be minimized by making the seal length of the vane 4*c* relatively long. Therefore, it is possible to improve the response in varying the phase of the valve timing adjusting device 100.

According to the first embodiment, still moreover, the seal plate 7 has the corrugation 72 and the elastic member 74, so that the manufacturing cost is reduced and the leakage of the working oil from the sectorial space 55 or the circumferential groove 61 to the outside is reliably prevented with the simple structure. Here, it is possible to prevent the leakage of the working oil no matter whether the elastic member 74 might be provided on only one side face of the seal plate 7 or only one of the corrugation 72 or the elastic member 74 is provided.

In the first embodiment, still moreover, the following relation is established between the internal diameter $W_{40}$ of the fixing hole 40 and the diametrical width $W_{70}$ of the through hole 70:

$$W_{40} > W_{70}$$

As a result, the radial biasing force of the torsion spring 60 is regulated by the inner wall of the through hole 70, and it is prevented from being transmitted to the vane 4*c*. Therefore, the eccentric wears of the vanes 4*a*, 4*b* and 4*c* are prevented, as might otherwise be caused by the frictions between the inner wall of the housing portion 51 forming the sectorial space 55 and the vanes 4*a*, 4*b* and 4*c* when these vanes 4*a*, 4*b* and 4*c* become eccentric.

Moreover, the vanes 4*a*, 4*b* and 4*c* can be easily assembled with the housing portion 51, so that the number of manufacturing steps are reduced.

In the first embodiment, still moreover, the sliding portion between the cam shaft 1 and the chain sprocket 8 is fed with the working oil from the circumferential groove 61 so that an excellent sliding surface is formed without forming any special oil passage in the cam shaft 1. Therefore, the sliding portion can be reduced in its wear to improve the durability with the simple structure.

Second Embodiment

Figure 11:
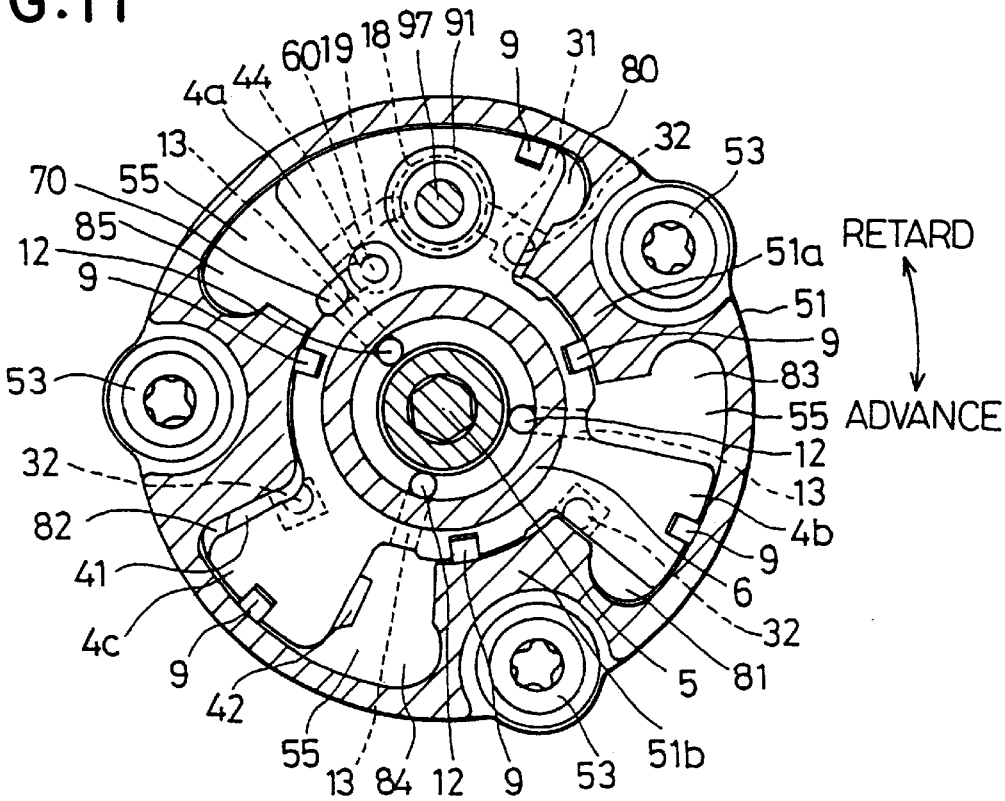
FIG. 11 is a longitudinal sectional view showing a valve timing adjusting device according to a second embodiment of the present invention.

With reference to FIG. 11, a second embodiment of the present invention in which the fixing hole 40 of the first embodiment shown in FIG. 2 is formed in the vane 4*a* will now be described. The remaining structures are similar to those of the first embodiment. In this and the following embodiments, components which are substantially the same as those in previous embodiments are assigned the same reference numerals.

In the second embodiment, as shown in FIG. 11, there is formed in the vane 4*a* a fixing hole 44 for fixing one end portion of the torsion spring 60. As a result, this torsion spring 60 is assembled by fixing its other end portion on the chain sprocket without providing any special member for receiving the biasing force of the torsion spring 60 having a larger external diameter than the internal diameter of the vanes 4*a*, 4*b* and 4*c*.

Moreover, the fixing hole 44 is easily formed because the vane 4*a* to be provided with the stopper piston 97 as the abutting portion is made thicker than the vane 4*b* for obtaining the strength. Therefore, the manufacturing cost is lowered with the simple structure.

Third Embodiment

Figure 12:
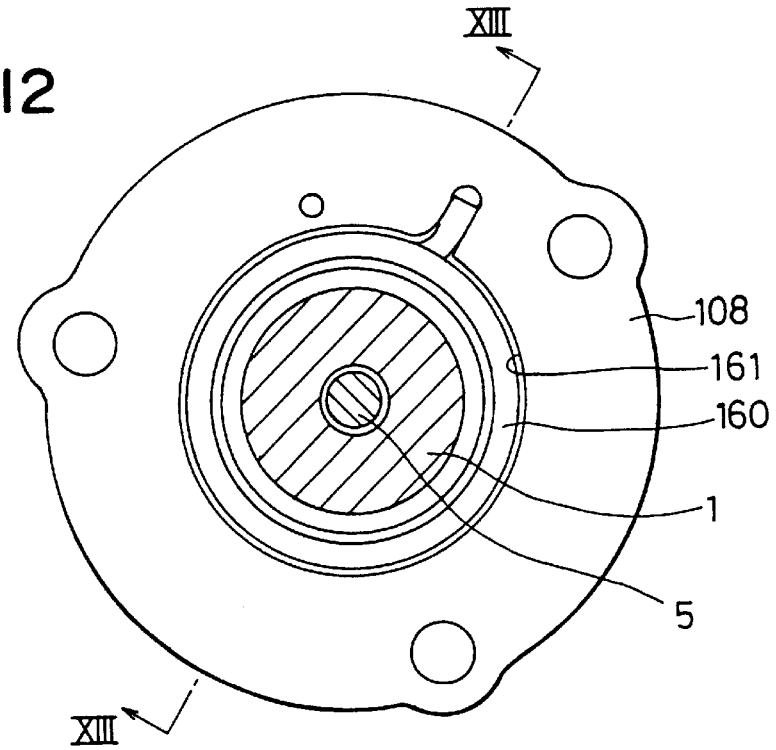
FIG. 12 is a longitudinal sectional view showing a valve timing adjusting device according to a third embodiment of the present invention.
Figure 13:
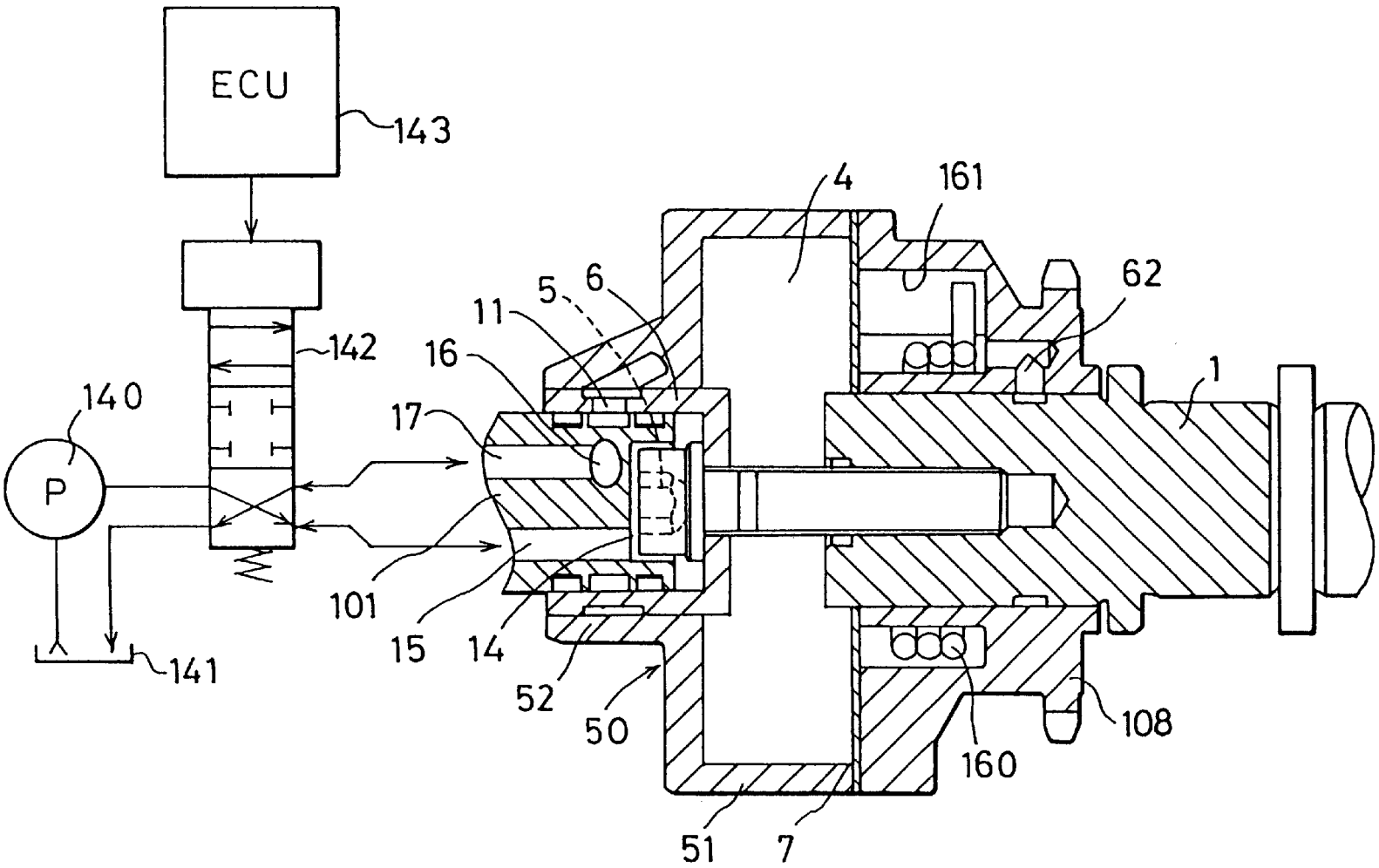
FIG. 13 is a sectional view taken along line XIII—XIII of FIG. 12.

With reference to FIGS. 12 and 13, here will be described a third embodiment in which the other end portion of the torsion spring 60 of the first embodiment shown in FIGS. 1 and 3 is extended in the radial direction and in which the circumferential groove 61 is also extended in the radial direction. The remaining structures are similar to those of the first embodiment.

In the third embodiment, as shown in FIGS. 12 and 13, a torsion spring 160 functioning as first bias means is housed in a circumferential groove 161 formed as a housing space in a chain sprocket 108. The torsion spring 160 is fixed at its one end portion on the vane rotor 4 and at its other end portion on the chain sprocket 108. The other end portion of the torsion spring 160 is extended in the radial direction, and the circumferential groove 161 is so formed in the chain sprocket 108 that it is also extended in the radial direction.

The torsion spring 160 biases the vane rotor 4 in the direction of the vane rotor 4 to advance with respect to the chain sprocket 108, that is, in the direction of the cam shaft 1 to advance with respect to the crank shaft.

According to the third embodiment, the circumferential groove 161 is made relatively shallow, so that the number of manufacturing steps is reduced. Since the chain sprocket 108 is reduced in the axial direction, moreover, the valve timing adjusting device is reduced in size to obtain the mounting space more easily for mounting the valve timing adjusting device on the engine.

According to the first through the third embodiments of the present invention, the housing portion 51 of the front member 50 and the vane rotor 4 are coupled at the most advanced position by the restraint means such that the valve opening periods of the exhaust valve and the intake valve may not overlap. However, the valve opening periods of the exhaust valve and the intake valve may overlap if this overlap period is within a range where the engine can be normally started to a driving state, and the coupling positions between the housing member and the vane member by the restraint means may be shifted to the retarded side from the most advanced position.

Although the first through the third embodiments have been described on the vane rotor 4 having the three vanes, the number of vanes may be one or more instead.

Furthermore, according to the first through the third embodiments of the present invention, the stopper piston 97 is moved in the axial direction of the vane rotor 4 so that it is fitted in the tapered hole. However, it may be modified such that the stopper piston is moved in the radial direction of the vane rotor and fitted in the tapered hole, or such that the stopper piston is housed in the chain sprocket.

On the other hand, the embodiments have adopted the structure in which the rotational driving force of the crankshaft is transmitted to the cam shaft via the chain sprocket, but can be modified to use a timing pulley, a timing gear or the like.

Furthermore, the driving force of the crankshaft as the drive shaft can be received by a vane rotor to rotate the cam shaft as the driven shaft integrally with the housing portion.

According to the first through the third embodiments, the present invention is applied to the valve timing adjusting device for the exhaust valve. However, the application of the present invention is not limited thereto but can be applied to a system in which an OHC engine or an OHV engine is provided with the valve timing adjusting device.

In this case, the valve opening timings for the intake/exhaust valves shift in parallel to the retarding direction by the valve timing adjusting device, so that the fuel economy can is improved by the parallel shifts of the valve opening timings. In this case, the reference position at the engine starting time is also located at the most advanced position, so that advantages similar to those in the first through the third embodiments can be obtained.

Furthermore, the present invention can also be applied to a valve timing adjusting device for the intake valve. This valve timing adjusting device for the intake valve is always subjected to a force in the retarding direction like the valve timing adjusting device for the exhaust valve. By providing the torsion spring as the first bias means, therefore, the operation speed (or the response) of the valve timing can be improved.

In this case, the biasing force of the torsion spring is preferably set weaker than the force in the retarding direction, as received by the valve timing adjusting device at the engine starting time. By setting the biasing force of the torsion spring, the most retarded position, that is, the reference position can be maintained at the starting time.

Fourth Embodiment

Figure 14:
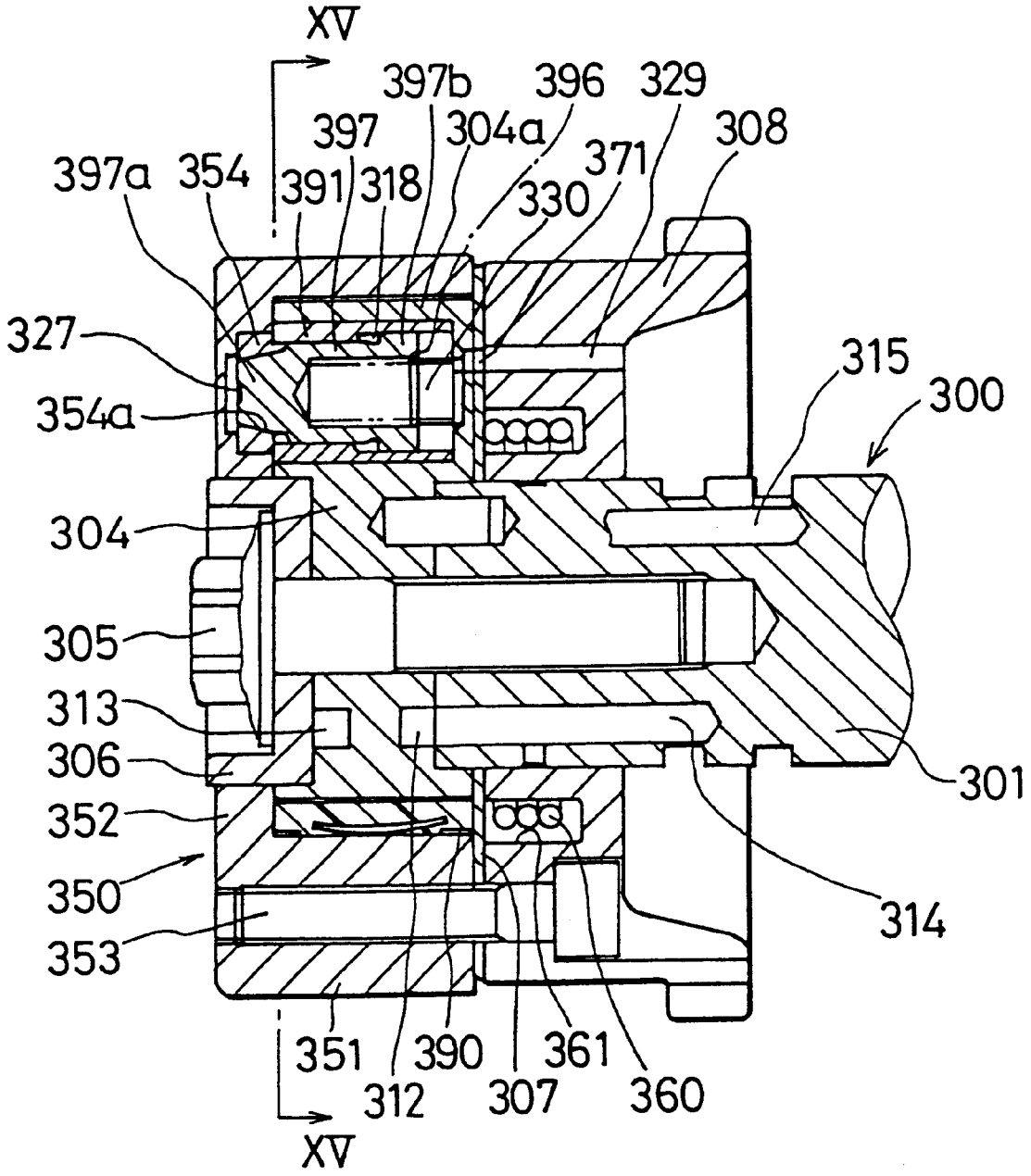
FIG. 14 is a longitudinal sectional view showing a valve timing adjusting device according to a fourth embodiment of the present invention.
Figure 15:
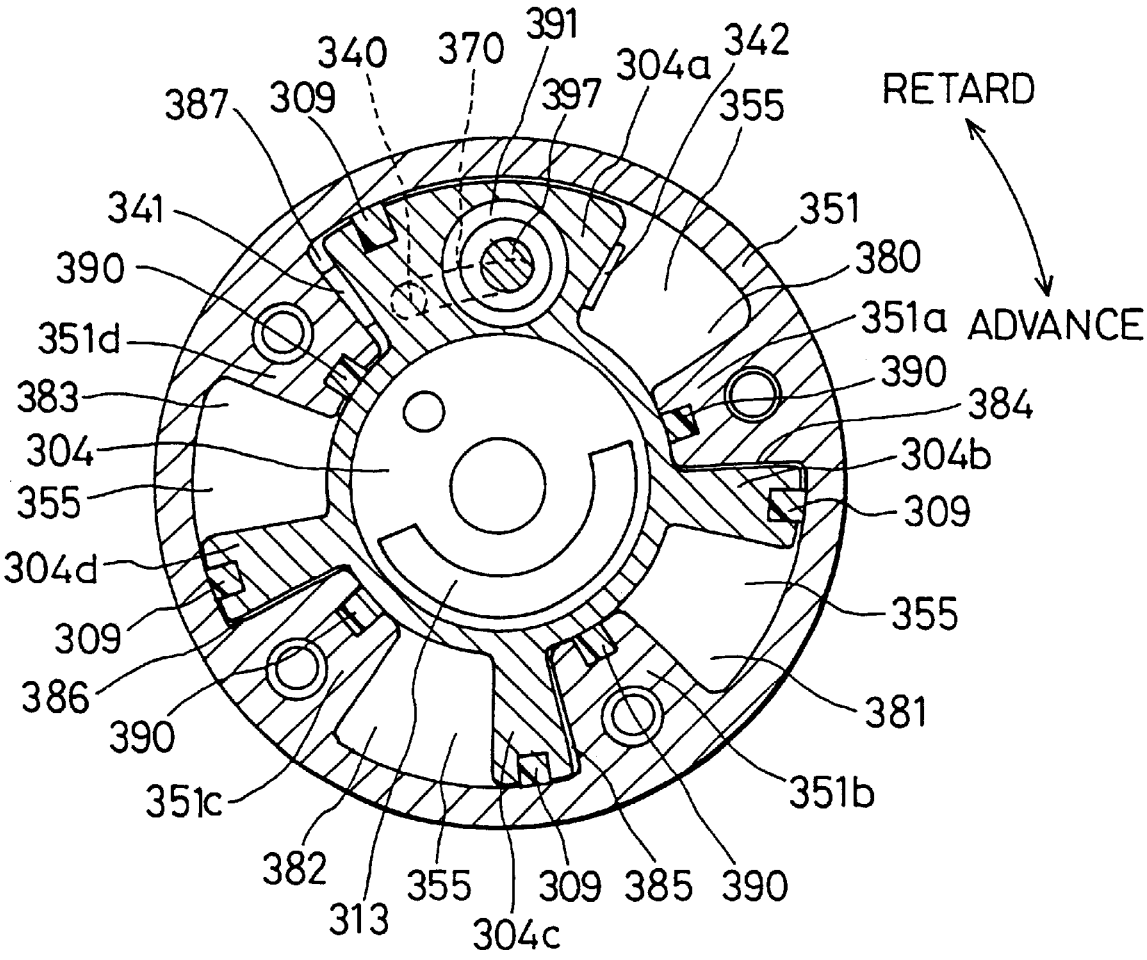
FIG. 15 is a sectional view taken along line XV—XV of FIG. 14.

A fourth embodiment of the present invention is shown in FIGS. 14 and 15. This valve timing adjusting device 300 in the fourth embodiment is a hydraulic control type for controlling the valve timing of an intake valve.

A chain sprocket 308, as shown in FIG. 14, is coupled through the not-shown timing chain to a crankshaft acting as the drive shaft of the not-shown engine so that it is rotated in synchronism with the crankshaft by a driving force transmitted thereto. A shoe housing 350 comprises a peripheral wall portion 351 and a front portion 352. The front portion 352, the chain sprocket 308 and a later-described seal plate 307 are coupled by a bolt 353.

A cam shaft 301 as a driven shaft receives the driving force from the chain sprocket 308 to open/close the not-shown intake valve. The cam shaft 301 is supported by a not-shown cylinder head so that it can rotate with a predetermined phase difference relatively to the chain sprocket 308. This chain sprocket 308 and the cam shaft 301 rotate clockwise, as viewed from the left-hand side of FIG. 14. This rotating direction will be called the "advance direction" hereinafter.

The chain sprocket 308 and the shoe housing 350 construct a housing member. A vane rotor 304 is covered at its two axial end surfaces with the seal plate 307 and the front portion 152 of the shoe housing 350. The chain sprocket 308, the seal plate 307 and the shoe housing 350 construct a drive side rotor and are coupled on a common axis by the bolt 353.

The vane rotor 304 is integrally connected to the cam shaft 301 by a bolt 305. A bush 306 is force fitted in the vane rotor 304 and is supported to form a driven side rotor.

The cam shaft 301 and the bush 306 are fitting in the front portion 352 of the shoe housing 350 respectively such that they can relatively rotate with the front portion 352.

Accordingly, the cam shaft 301, the vane rotor 304 and the bush 306 are relatively rotatable with the chain sprocket 308 and the shoe housing 350 coaxially.

A torsion spring 360 acting as first bias means is housed in a circumferential groove 361 formed as a housing space in the chain sprocket 308, and is fixed at its one end portion to the vane rotor 304 and at its other end to the chain sprocket 308. The torsion spring 360 biases the vane rotor 304 in the direction for the vane rotor 304 to advance with respect to the chain sprocket 308, that is, for the cam shaft 301 to advance with respect to the crankshaft.

Figure 18:
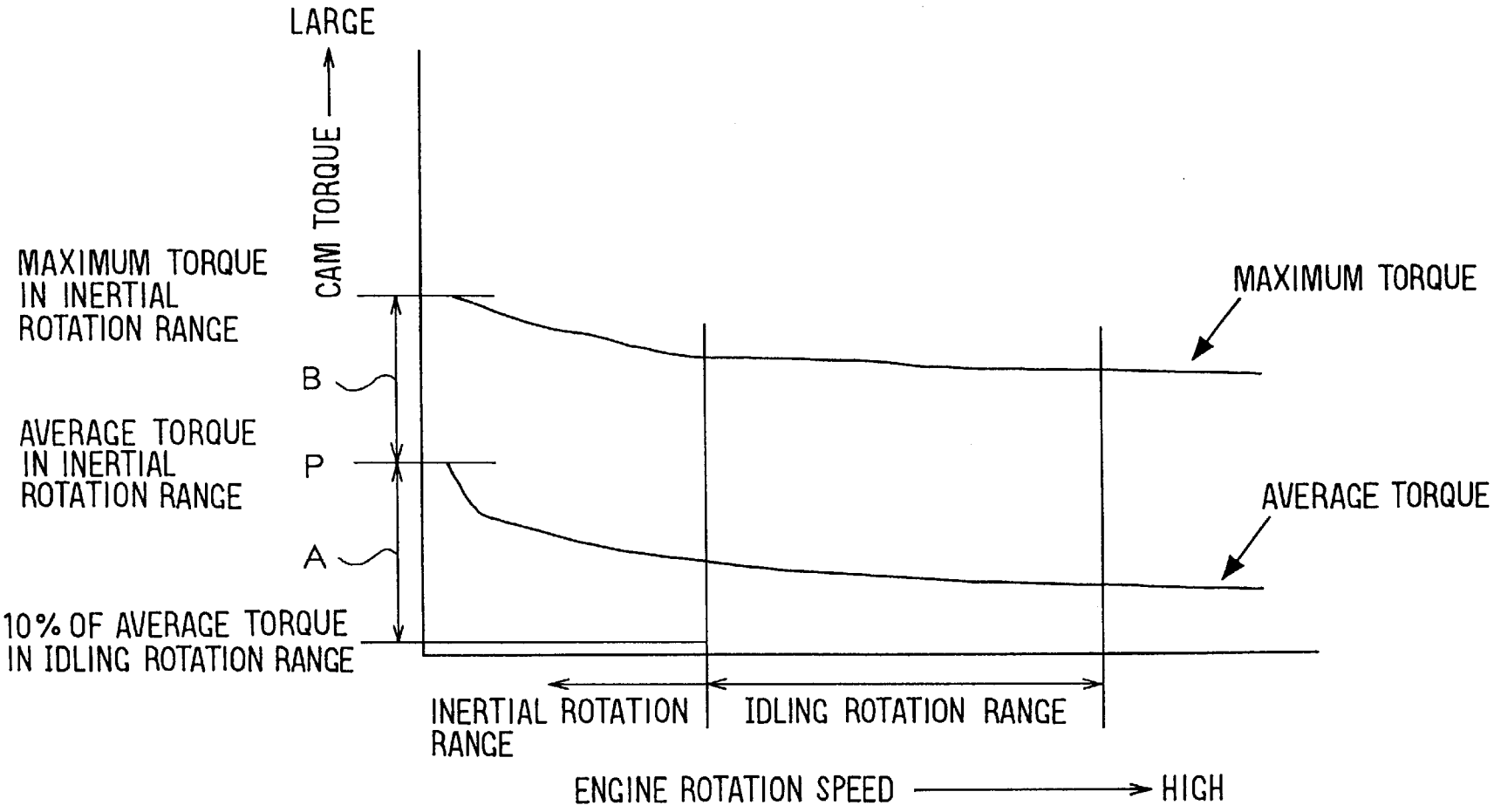
FIG. 18 is a characteristic graph showing relations between engine rotation speed and cam torque.

As shown by the area designated by an arrow A in FIG. 18, the biasing force of the torsion spring 360 is set to 10% of the average torque in the idling rotation range of the cam shaft 301 or greater. The biasing force of the torsion spring 360 is also set to be equal to or less than the average torque in the inertial rotation range of the cam shaft 301.

In the fourth embodiment, the torsion spring 360 has a biasing force (spring force) P corresponding to the maximum value of the average torque in the inertial rotation range.

The "inertial rotation range" is an engine rotation range after engine stopping operation. Further, "equal to or less than the average torque in the inertial rotation range" means that it is equal to or less than the average torque at the lowest rotation speed in the inertial rotation range right before stopping.

As shown in FIG. 15, the peripheral wall portion 351 of the shoe housing 350 has shoes 351*a*, 351*b*, 351*c* and 351*d* formed in a trapezoidal shape at a substantially equal spacing in the circumferential direction. In the four circumferential clearances of the shoes 351*a*, 351*b*, 351*c* and 351*d*, there are individually formed sectorial spaces 355 as housing chambers for respective housing vanes 34*a*, 34*b*, 34*c* and 34*d* as vane members. Inner circumferential surface of the shoes 351*a*, 351*b*, 351*c* and 351*d* are formed to have an arcuate cross section.

The vane rotor 304 is provided substantially equidistantly in the circumferential direction with the vanes 304*a*, 304*b*, 304*c* and 304*d* which are rotatably housed in the sectorial spaces 355 formed in the circumferential clearances of the shoes 351*a*, 351*b*, 351*c* and 351*d*.

The vane 4*c* is provided on the advance side with an advance stopper 41 and on the retard side with a retard stopper 42. Arrows, as appearing in FIG. 15, indicate the retard direction and the advance direction of the vane rotor 304 with respect to the peripheral wall portion 351.

In FIG. 15, each vane is positioned at one circumferential end portion of each sectorial space 355 such that the vane rotor 304 is positioned at the most retarded position with respect to the peripheral wall portion 351. The most retarded position is regulated by retaining the retard stopper 341 provided at the retard side face of the vane 304*a* to the advanced side face of the shoe 351*d*. On the other hand, the most advanced position is regulated by retaining the advance stopper 342 provided at the advance side face of the vane 304*a* to the retard side face of the shoe 351*a*.

As shown in FIG. 14, the vanes 304*a*, 304*b*, 304*c* and 304*d* are set to have an internal diameter smaller than the external diameter of the torsion spring 360. As shown in FIG. 15, on the other hand, the vane 304*a* is provided with a fixing hole 340 for fixing one end portion of the torsion spring 360.

By fixing the other end portion of the torsion spring 360 to the chain sprocket 308, therefore, this torsion spring 360 can be assembled without providing any special member for receiving the biasing force of the torsion spring 360 having a larger external diameter than the internal diameter of the vanes 304*a*, 304*b*, 304*c* and 304*d*. Moreover, the fixing hole 340 is easily formed because the vane 304*a* having the retard stopper 341 and the advance stopper 342 is made thicker than the vanes 304*b*, 304*c* and 304*d* to increase the strength.

As shown in FIG. 15, the seal member 309 is fitted on the outer circumferential wall of the vanes 304*a*, 304*b*, 304*c* and 304*d*. Furthermore, the seal member 390 is fitted in the inner circumferential wall of the shoes 351*a*, 351*b*, 351*c* and 351*d*. A small clearance is provided between the outer circumferential wall of the vane rotor 304 and the inner circumferential wall of the peripheral wall portion 351 of the shoe housing 350. Seal members 309 and 390 prevent the leakage of the working oil between the oil pressure chambers through the clearance.

A guide ring 391 is press fitted in the inner wall of the vane 304*a*, and a stopper piston 397 is inserted in the guide ring 391. As shown in FIG. 14, the stopper piston 397 is formed into a bottomed cylindrical shape of a substantially equal external diameter, which is composed of a bottomed cylindrical portion 397*a* and a flange portion 397*b* formed at the open end portion of the cylindrical portion 397*a*.

The stopper piston 397 is housed in the guide ring 391 such that the stopper piston 397 is slidable in the axial direction of the cam shaft 301. The stopper piston 397 is biased to the side opposite to the chain sprocket 308 by a spring 396 functioning as second bias means.

In the stopper hole formed in the front portion 352 of the shoe housing 350, there is press-fitted a fitting ring 354 having a tapered hole 354*a*, so that the stopper piston 397 can be fitted in the tapered hole 354*a* at the most retarded position shown in FIG. 15.

When the stopper piston 397 is so fitted in the tapered hole 354*a* that the former comes into abutment against the latter in the rotational direction, the vane rotor 304 is restrained from rotating relatively to the peripheral wall portion 351. In short, the stopper piston 397 and the tapered hole 354*a* take the restrained positions at the most retarded position. The stopper piston 397, the tapered hole 354*a* and the spring 396 construct restraint means.

The oil pressure chamber 318, as located on the left-hand side of the flange portion 397*b*, communicates with a later-described retard angle oil pressure chamber 380 via an oil passage not shown. Furthermore, an oil pressure chamber 327, as formed on the tip of the cylindrical portion 397*a*, communicates with a later-described advance angle oil pressure chamber 387 via an oil passage not shown.

The area of a second pressure receiving surface of the flange portion 397*b* for receiving the oil pressure of the oil pressure chamber 318 is less than that of a first pressure receiving surface of the cylindrical portion 397*a* for receiving the oil pressure of the oil pressure chamber 327. The pressures to be received by the first pressure receiving surface and the second pressure receiving surface from the working oil in respective oil pressure chambers 327 and 318 act to extract the stopper piston 397 from the tapered hole 354*a*.

The pressure receiving area of the first pressure receiving surface is substantially equal to the sectional area of the cylindrical portion 397*a*, and the pressure receiving area of the second pressure receiving surface is substantially equal to the annular area corresponding to the diametrical difference between the flange portion 397*b* and the cylindrical portion 397*a*. When the working oil having a predetermined or higher pressure is supplied to the advance angle oil pressure chamber 387 or the retard angle oil pressure chamber 380, the stopper piston 397 is extracted from the tapered hole 354*a* against the biasing force of the spring 396.

The position of the stopper piston 397 and the position of the tapered hole 354*a* are so relatively determined that the stopper piston 397 can be fitted in the tapered hole 354*a* by the biasing force of the spring 396 when the vane rotor 304 is at the most retarded position relatively to the peripheral wall portion 351 of the shoe housing 350, that is, when the cam shaft 301 is at the most retarded position relatively to the crankshaft.

As shown in FIG. 15: the retard angle oil pressure chamber 380 is formed between the shoe 351*a* and the vane 304*a*; a retard angle oil pressure chamber 381 is formed between the shoe 351*b* and the vane 304*b*; a retard angle oil pressure chamber 382 is formed between the shoe 351*c* and the vane 304*c*; and a retard angle oil pressure chamber 383 is formed between the shoe 351*d* and the vane 304*d*.

On the other hand: an advance angle oil pressure chamber 384 is formed between the shoe 351*a* and the vane 304*b*; an advance angle oil pressure chamber 385 is formed between the shoe 351*b* and the vane 304*c*; the advance angle oil pressure chamber 386 is formed between the shoe 351*c* and the vane 304*d*; and an advance angle oil pressure chamber 387 is formed between the shoe 351*d* and the vane 304*a*.

As shown in FIG. 14, the seal plate 307 as a partition member separates the sectorial space 355 from the circumferential groove 361. In other words, the seal plate 307 separates a housing chamber for housing the vanes 304*a*, 304*b*, 304*c* and 304*d* from a housing space for housing the torsion spring 360. As a result, the sectorial space 355 is constructed such that the advance angle oil pressure chambers 84, 85, 86 and 87 and the retard angle oil pressure chambers 80, 81, 82 and 83 are not connected regardless of the space of the circumferential groove 61.

As shown in FIG. 15, a circumferentially elongated through hole 370 is formed in the seal plate 307. One end portion of the torsion spring 360 can be passed through the through hole 370. The vane 304*a* closes the through hole 370 at the most advanced position shown in FIG. 15.

As shown in FIG. 14, a communication passage 371 which communicates with a back pressure chamber 330 of the stopper piston 397 is formed in the seal plate 307. The communication passage 371 communicates with the atmosphere in the oil lubricating space of the not-shown engine via an oil passage 329 formed in the chain sprocket 308 at the most retarded position, so that the back pressure chamber 330 communicates with the atmosphere at the most retarded position. As a result, the movement of the stopper piston 397 is not prevented at the most retarded position.

In the vane rotor 304, an oil passage 312 is formed at the portion abutting against the cam shaft 301, and an oil passage 313 is formed at the portion abutting against the bush 306. The oil passage 313 communicates with the advance angle oil pressure chambers 384, 385, 386 and 387 via an oil passage not shown.

Furthermore, the oil passage 312 communicates with either an hydraulic pump functioning as drive means or a drain via the oil passage 314 formed in the cam shaft 301. The hydraulic pump also functions as a drive source for the engine lubricating oil.

Furthermore, the oil passage 315 shown in FIG. 14 communicates with the hydraulic pump or the drain via a switching valve, and communicates with the retard angle oil pressure chambers 380, 381, 382 and 383. The oil pressure of the working oil supplied to the advance angle oil pressure chambers 384, 385, 386 and 387 is a first fluid pressure. The oil pressure of the working oil supplied to the retard angle oil pressure chambers 380, 381, 382 and 383 is a second fluid pressure.

A release oil pressure at the advanced position for the restraint means is less than the minimum working pressure necessary for rotating the vane rotor 304 to the advancing direction with respect to the shoe housing 350 by the first fluid pressure. operations of the valve timing adjusting device 300 will now be described.

(1) When the engine stops normally, the change-over valve is controlled such that the retard angle oil pressure chambers 380, 381, 382 and 383 are released to the drain side while respective advance angle oil pressure chambers 384, 385, 386 and 387 are held in the working oil pressure applied state. Then, the vane rotor 304 moves to the most retarded position with respect to the peripheral wall portion 351 of the shoe housing 350, and the front portion 352 and the vane rotor 304 are coupled by the restraint means, so that the cam shaft 301 is held in the most retarded position with respect to the peripheral wall portion 351.

According to the fourth embodiment of the present invention, it is designed to have no overlap for valve opening period between the exhaust valve and the intake valve at the most retarded position shown in FIG. 15. Accordingly, it can reduce the internal EGR ratio and start the engine normally. Even after the engine is started, the front portion 352 and the vane rotor 304 are held in the coupled state by the restraint means. As a result, the cam shaft 301 is at the most retarded position with respect to the peripheral wall portion 351 till the working oil pressure to be applied to respective oil passages and the oil pressure chambers exceeds a predetermined level.

(2) When the engine turns into the normal driving condition and a working oil whose pressure is higher than the predetermined level is introduced into the respective oil passages and oil pressure chambers, the pressure is applied to the first pressure receiving surface by the negative peak torque of the fluctuating torque of the cam shaft 301 during the idling, thereby releasing the coupling between the front portion 352 and the vane rotor 304 by the restraint means.

At this time, no shearing force is applied to catch the stopper piston 397 so that the front portion 352 and the vane rotor 304 can be promptly released from each other. As a result, the vane rotor 304 is rotated relatively to the peripheral wall portion 351 against the biasing force of the torsion spring 360 by the working oil pressure applied to the retard angle oil pressure chambers 380, 381, 382 and 383 and the advance angle oil pressure chambers 384, 385, 386 and 387, so that the phase difference of the cam shaft 301 relatively to the peripheral wall portion 351 is adjusted.

According to the fourth embodiment of the present invention, the torsion spring 360 applies the biasing force to the vane rotor 304 in a direction in which the cam shaft 301 advances against the crank shaft. Accordingly, the phase transition response is uniformed, and the controllability is improved.

Furthermore, since the first fluid pressure is reduced, the pressure difference between the advance angle oil pressure chambers 384, 385, 386 and 387 and the retard angle oil pressure chambers 380, 381, 382 and 383 is reduced. Accordingly, the working oil leakage between the advance angle oil pressure chambers and the retard oil pressure chambers is reduced.

Furthermore, the area of the vanes 304*a*, 304*b*, 304*c* and 304*d* is reduced, and the actuator is reduced in size without compromising the engine performance. Accordingly, the weight of the valve timing adjusting device 300 is reduced, and the mounting space for mounting it on the engine is easily obtained.

Furthermore, since the minimum working pressure of the hydraulic pump is reduced, the hydraulic pump is reduced in size, and the manufacturing cost is reduced.

According to the fourth embodiment of the present invention, further, the biasing force of the torsion spring 360 is set to 10% of the average torque in the idling rotation range of the cam shaft 301 or greater, and is also set to be equal to or less than the average torque in the inertial rotation range of the cam shaft 301. Accordingly, the biasing force of the torsion spring 360 is less than a force in the retarding direction to be applied to the valve timing adjusting device 300 at the start of the engine. Therefore, the driven shaft is reliably returned to the most retarded position at the stop of the engine, and the intake side is held at the most retarded position, that is, the reference position at the start of the engine. Therefore, the overlapping period, in which the exhaust valve and the intake valve open their valves with a certain overlap, can be reduced to certain degree to at least enable the start of the engine. Accordingly, the engine start performance is improved.

Furthermore, the exhausted amount of the unburned fuel, exhausted from the exhaust valve after the fuel is sucked from the intake valve, is reduced. Further, the phase transition response is uniformed, and the controllability is improved.

Further, according to the fourth embodiment of the present invention, the release oil pressure at the advanced position for the restraint means is less than the minimum working pressure necessary for rotating the vane rotor 304 to the advancing direction with respect to the shoe housing 350 by the first fluid pressure.

Accordingly, the restrained condition between the front portion 352 and the vane rotor 304 by the restraint means is reliably released even under low pressure of the working oil without increasing the hydraulic pump in size to increase the oil pressure, and without increasing the stopper piston 397 to increase the pressure receiving area. Thus, the relative rotation between the front portion 352 and the vane rotor 304 becomes possible.

Fifth Embodiment

A fifth embodiment of the present invention will now be described according to FIGS. 16 and 17. In the fifth embodiment of the present invention, the torsion spring 360 in the fourth embodiment is replaced by a coil spring 560. Other structures are substantially the same as those in the fourth embodiment of the present invention.

Figure 16:
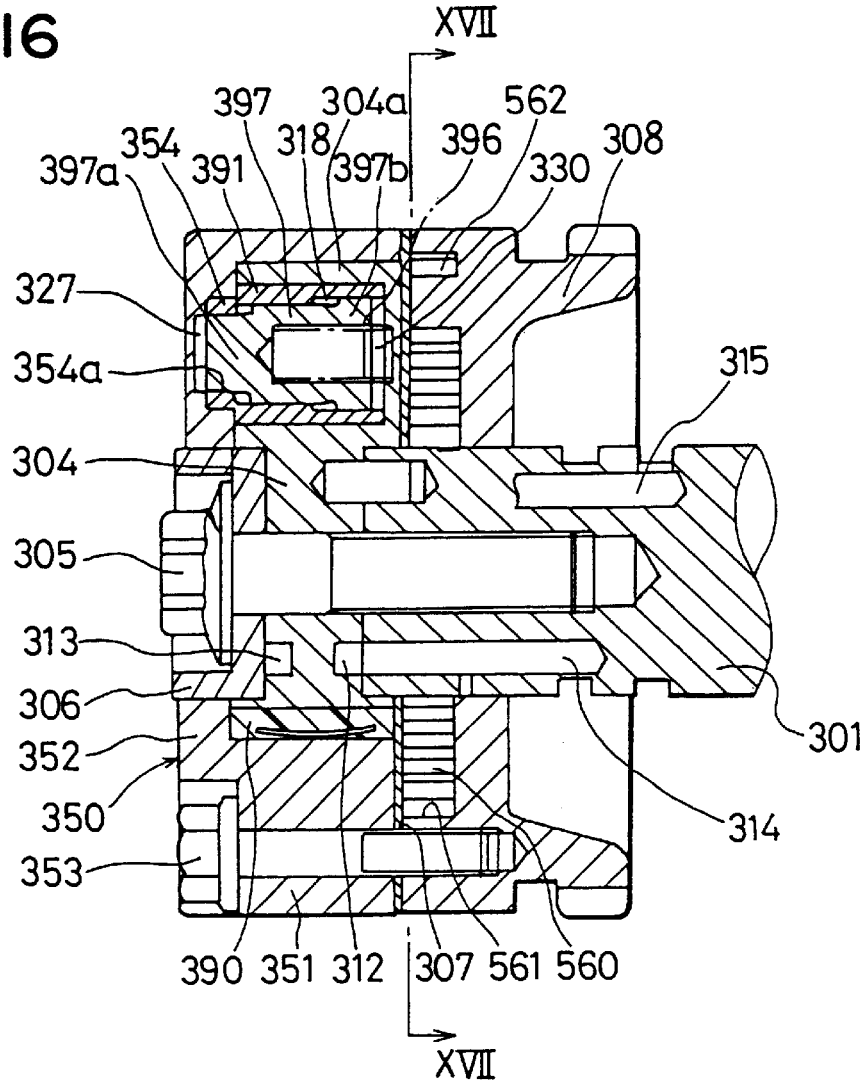
FIG. 16 is a longitudinal sectional view showing a valve timing adjusting device according to a fifth embodiment of the present invention.
Figure 17:
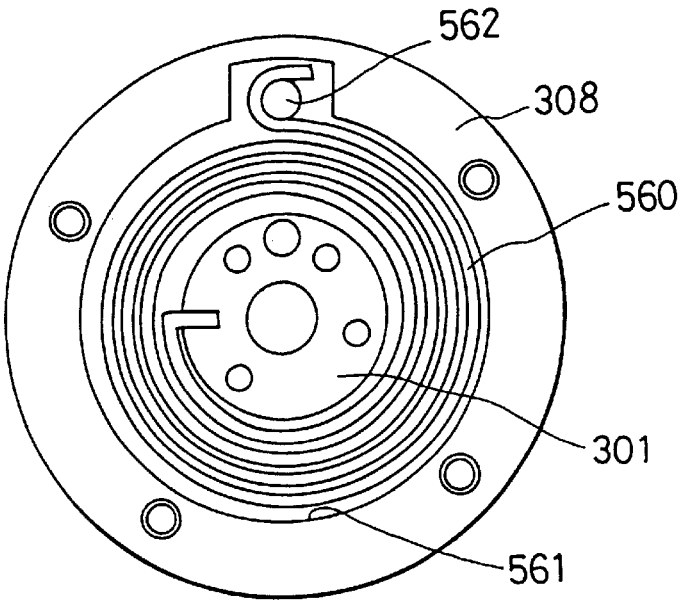
FIG. 17 is a sectional view taken along line XVII—XVII of FIG. 16.

As shown in FIGS. 16 and 17, the coil spring 560 as first bias means is housed in a circumferential groove 561, that is, a housing space formed in the chain sprocket 308. One end of the coil spring 560 is fixed to the cam shaft 301, and the other end is fixed to a fixing portion 562 which is formed on the chain sprocket 308 and which protrudes in the axial direction.

The coil spring 560 applies its biasing force to the vane rotor 304 in the advancing direction of the vane rotor 304 against the chain sprocket 308, that is, the advancing direction of the cam shaft 301 against the crank shaft.

The biasing force of the coil spring 560 is greater than 10% of the average torque in the idling rotation range of the cam shaft 301, and is less than the average torque in the inertial rotation range of the cam shaft 301.

According to the fifth embodiment of the present invention, since the coil spring 560 applies its biasing force to the vane rotor 304 in the advancing direction of the cam shaft 301 against the crank shaft, the phase transition response is uniformed, and the controllability is improved.

Furthermore, since the first fluid pressure is substantially reduced, the pressure difference between the advance angle oil pressure chamber and the retard angle oil pressure chamber is reduced, and the working oil leakage between the advance angle oil pressure chamber and the retard angle oil pressure chamber is reduced.

Further, the area of the vane is reduced, and the actuator is reduced in size without compromising the engine performance. Accordingly, the weight of the valve timing adjusting device is reduced, and the mounting space for mounting it on the engine is easily obtained.

Furthermore, since the minimum working pressure of the hydraulic pump is reduced, the hydraulic pump is reduced in size, and the manufacturing cost is reduced.

According to the fifth embodiment of the present invention, further, the biasing force of the coil spring 560 is set to 10% of the average torque in the idling rotation range of the cam shaft 301 or greater, and is also set to be equal to or less than the average torque in the inertial rotation range of the cam shaft 301. Accordingly, the biasing force of the coil spring 560 is less than a force in the retarding direction to be applied to the valve timing adjusting device at the start of the engine.

Therefore, the driven shaft is reliably returned to the most retarded position at the stop of the engine, and the intake side is held at the most retarded position, that is, the reference position at the start of the engine. Therefore, the overlapping period, in which the exhaust valve and the intake valve open their valves with a certain overlap, can be reduced to certain degree to at least enable the start of the engine. Accordingly, the engine start performance is improved.

Furthermore, the exhausted amount of the unburned fuel, exhausted from the exhaust valve after the fuel is sucked from the intake valve, is reduced. Further, the phase transition response is uniformed, and the controllability is improved.

In the fourth and the fifth embodiments of the present invention, the biasing force of the first bias means is set to 10% of the average torque in the idling rotation range of the cam shaft 301 or greater, and is also set to be equal to or less than the average torque in the inertial rotation range of the cam shaft 301.

However, the biasing force of the first bias means may be greater than the average torque in the inertial rotation range of the cam shaft and less than the maximum torque in the inertial rotation range of the cam shaft, that is, the range designated by the arrow B in FIG. 18. In this case, the phase transition response for the relative rotation of the vane rotor against the shoe housing in the advancing direction is improved.

Accordingly, the driven shaft is reliably returned to the most retarded position when the engine stops, and the pressure of the working oil supplied to the advance angle oil pressure chamber is further reduced. Thus,the pressure difference between the advance angle oil pressure chamber and the retard angle oil pressure chamber is further reduced, and the working oil leakage between the advance angle oil pressure chamber and the retard angle oil pressure chamber is further reduced.

Furthermore, according to the fourth and fifth embodiments of the present invention, the fluid pressure is applied to the second pressure receiving surface by controlling the change-over valve to move the intake valve in the advancing direction. Accordingly, the restrained condition between the front portion and the vane rotor is immediately released without being caught by shearing force on the stopper piston. By controlling the change-over valve thereafter, the vane rotor is rotated relatively to the front portion in the advancing direction, and the intake valve is promptly moved in the advancing direction.

Further, according to the fourth and fifth embodiments of the present invention, the front portion of the shoe housing and the vane rotor 304 are coupled at the most retarded position to prevent an overlap of the valve opening period between the exhaust valve and the intake valve. However, the valve opening periods of the exhaust valve and the intake valve may overlap within a certain range such that the engine normally starts and shifts to the driving condition. Further, the coupling position between the housing member and the vane member by the restraint means may be advanced side than the most retarded position.

Although the fourth and fifth embodiments have been described on the vane rotor 304 having the four vanes, the number of the vanes may be one or more instead.

Furthermore, according to the fourth and fifth embodiments of the present invention, the stopper piston 397 is moved in the axial direction of the vane rotor 304 so that it is fitted in the tapered hole. However, it may be modified such that the stopper piston is moved in the radial direction of the vane rotor and fitted in the tapered hole, or such that the stopper piston is housed in the chain sprocket.

On the other hand, the embodiments have adopted the structure in which the rotational driving force of the crankshaft is transmitted to the cam shaft via the chain sprocket, but can be modified to use a timing pulley, a timing gear or the like.

Furthermore, the driving force of the crankshaft as the drive shaft can be received by a vane rotor to rotate the cam shaft as the driven shaft integrally with the housing portion.

Although the present invention has been described in connection with the preferred embodiments thereof with reference to the accompanying drawings, it is to be noted that various changes and modifications will be apparent to those skilled in the art. Such changes and modifications are to be understood as being included within the scope of the present invention as defined in the appended claims.

What is claimed is:

1. A valve timing adjusting device for an internal combustion engine having a drive shaft, an intake valve, an exhaust valve and a driven shaft which opens and closes at least one of the intake valve and the exhaust valve, comprising:

a housing which rotates together with the drive shaft, said housing having a housing chamber defined therein;

a chain sprocket mounted to at least one of the drive shaft and the housing for rotating together therewith, said chain sprocket having a chain sprocket space defined therein;

a vane housed in said housing chamber to rotate together with the driven shaft relative to said housing within a predetermined rotational phase difference;

an advance angle fluid pressure chamber for rotating said vane relative to said housing in an advancing direction by a fluid pressure;

a retard angle fluid pressure chamber for rotating said vane relative to said housing in a retarding direction by said fluid pressure;

a hydraulic pump for supplying a working fluid to said advance angle fluid pressure chamber and to said retard angle fluid pressure chamber;

first bias means housed in said chain sprocket space for biasing said vane in an advancing direction of the driven shaft relative to the drive shaft; and a partition member provided between said housing and said chain sprocket for separating said housing chamber from said chain sprocket space, wherein said partition member comprises a seal that prevents fluid from leaking out from said housing chamber or said chain sprocket space to an outside thereof.

2. A valve timing adjusting device as in claim 1, wherein said vane includes a fixing hole for fixing one end of said first bias means.

3. A valve timing adjusting device as in claim 1, wherein said partition member comprises a seal plate disposed between said housing chamber and said chain sprocket space.

4. A valve timing adjusting device as in claim 3, wherein a corrugation is formed in said seal plate a about an entire outer periphery thereof.

5. A valve timing adjusting device as in claim 3, wherein said seal plate comprises a metal plate and first and second elastic members provided on first and second faces of the metal plate.

6. A valve timing adjusting device as in claim 5, wherein said elastic members are provided by one of adhering or coating elastic material on each face of the metal plate.

7. A valve timing adjusting device as in claim 6, wherein said elastic material comprises acrylic rubber.

8. A valve timing adjusting device as in claim 1, wherein said partition member includes guide means for guiding an end of said first bias means.

9. A valve timing adjusting device for an internal combustion engine having a drive shaft, an intake valve, an exhaust valve and a driven shaft which opens and closes at least one of the intake valve and the exhaust valve, comprising:

a housing which rotates together with one of the drive shaft and the driven shaft;

a housing chamber formed in said housing;

a vane housed in said housing chamber to rotate together with the other one of the drive shaft and the driven shaft relative to said housing within a predetermined rotational phase difference;

an advance angle fluid pressure chamber for rotating one of said housing and said vane relative to the other one of said housing and said vane in an advancing direction by a fluid pressure;

a retard angle fluid pressure chamber for rotating one of said housing and said vane relative to the other one of said housing and said vane in a retarding direction by said fluid pressure;

a hydraulic pump for supplying a working fluid to said advance angle fluid pressure chamber and said retard angle fluid pressure chamber;

first bias means housed in a housing space formed in said housing for biasing said vane in an advancing direction of the driven shaft relative to the drive shaft; and a partition member for separating said housing chamber from said housing space, wherein said partition member includes guide means for guiding an end of said first bias means;

said guide means includes a fixing hole provided at said vane for fixing said end of said first bias means and includes a through hole provided at said partition member for passing said end of said first bias means; and said guide means is arranged such that a width of said fixing hole in a diametrical direction of said vane is larger than a width of said through hole in a diametrical direction of said partition member.

10. A valve timing adjusting device for an internal combustion engine having a drive shaft, an intake valve, an exhaust valve and a driven shaft which opens and closes at least one of the intake valve and the exhaust valve, comprising:

a housing which rotates together with one of the drive shaft and the driven shaft;

a housing chamber formed in said housing;

a vane housed in said housing chamber to rotate together with the other one of the drive shaft and the driven shaft relative to said housing within a predetermined rotational phase difference;

an advance angle fluid pressure chamber for rotating one of said housing and said vane relative to the other one of said housing and said vane in an advancing direction by a fluid pressure;

a retard angle fluid pressure chamber for rotating one of said housing and said vane relative to the other one of said housing and said vane in a retarding direction by said fluid pressure;

a hydraulic pump for supplying a working fluid to said advance angle fluid pressure chamber and said retard angle fluid pressure chamber;

first bias means housed in a housing space formed in said housing for biasing said vane in an advancing direction of the driven shaft relative t the drive shaft; and a partition member for separating said housing chamber from said housing space, wherein said vane includes a fixing hole for fixing one end of said first bias means;

said partition member includes a through hole for passing said one end of said first bias means; and said through hole communicates with one of said advance angle fluid pressure chamber and said retard angle fluid pressure chamber.

11. A valve timing adjusting device as in claim 10, wherein said through hole communicates with said advance angle fluid pressure chamber.

12. A valve timing adjusting device for an internal combustion engine having a drive shaft, an intake valve, an exhaust valve and a driven shaft which opens and closes at least one of the intake valve and the exhaust valve, comprising:

a housing which rotates together with one of the drive shaft and the driven shaft;

a housing chamber formed in said housing;

a vane housed in said housing chamber to rotate together with the other one of the drive shaft and the driven shaft relative to said housing within a predetermined rotational phase difference;

an advance angle fluid pressure chamber for rotating one of said housing and said vane relative to the other one of said housing and said vane in an advancing direction by a fluid pressure;

a retard angle fluid pressure chamber for rotating one of said housing and said vane relative to the other one of said housing and said vane in a retarding direction by said fluid pressure;

a hydraulic pump for supplying a working fluid to said advance angle fluid pressure chamber and said retard angle fluid pressure chamber;

first bias means housed in a housing space formed in said housing for biasing said vane in an advancing direction of the driven shaft relative to the drive shaft; and a partition member for separating said housing chamber from said housing space, wherein said partition member includes seal means for preventing a fluid from leaking from said housing chamber or said housing space to an outside thereof, and said seal means includes a corrugation formed on said partition member.

13. A valve timing adjusting device for an internal combustion engine having a drive shaft, an intake valve, an exhaust valve and a driven shaft which opens and closes at least one of the intake valve and the exhaust valve, comprising:

a housing which rotates together with one of the drive shaft and the driven shaft;

a housing chamber formed in said housing;

a vane housed in said housing chamber to rotate together with the other one of the drive shaft and the driven shaft relative to said housing within a predetermined rotational phase difference;

an advance angle fluid pressure chamber for rotating one of said housing and said vane relative to the other one of said housing and said vane in an advancing direction by a fluid pressure;

a retard angle fluid pressure chamber for rotating one of said housing and said vane relative to the other one of said housing and said vane in a retarding direction by said fluid pressure;

a hydraulic pump for supplying a working fluid to said advance angle fluid pressure chamber and said retard angle fluid pressure chamber;

first bias means housed in a housing space formed in said housing for biasing said vane in an advancing direction of the driven shaft relative to the drive shaft; and a partition member for separating said housing chamber from said housing space, wherein said partition member includes seal means for preventing a fluid from leaking from said housing chamber or said housing space to an outside thereof, and said seal means includes an elastic member disposed on at least one side face of said partition member.

* * * * *